US009090109B1

(12) United States Patent
Jo et al.

(10) Patent No.: US 9,090,109 B1
(45) Date of Patent: Jul. 28, 2015

(54) PRINTER

(71) Applicant: Brother Kogyo Kabushiki Kaisha, Nagoya-shi, Aichi-ken (JP)

(72) Inventors: Hidenori Jo, Nagoya (JP); Minoru Yamamoto, Nagoya (JP); Takamine Hokazono, Kasugai (JP); Yuki Nagashima, Nagoya (JP); Kenji Kurita, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/579,182

(22) Filed: Dec. 22, 2014

(30) Foreign Application Priority Data

Feb. 28, 2014 (JP) ..... 2014-038940

(51) Int. Cl.
*B41J 2/01* (2006.01)
*B41J 15/04* (2006.01)
*B41J 3/407* (2006.01)

(52) U.S. Cl.
CPC ..... *B41J 15/04* (2013.01); *B41J 3/4075* (2013.01)

(58) Field of Classification Search
USPC ..... 347/101, 104, 105, 171, 212, 213–215, 347/217–219; 400/611, 613, 618, 621, 400/621.1, 663, 582
See application file for complete search history.

(56) References Cited

U.S. PATENT DOCUMENTS

| | | | | |
|---|---|---|---|---|
| 5,980,138 | A * | 11/1999 | Shiozaki et al. | 400/582 |
| 6,609,844 | B1 * | 8/2003 | Petteruti et al. | 400/613 |
| 6,916,052 | B2 * | 7/2005 | Yamada et al. | 400/663 |
| 7,695,206 | B2 | 4/2010 | Kawakami et al. | |
| 8,070,372 | B2 | 12/2011 | Kawakami et al. | |
| 2005/0069370 | A1 | 3/2005 | Yamada et al. | |
| 2010/0178094 | A1 | 7/2010 | Kawakami et al. | |

FOREIGN PATENT DOCUMENTS

| | | | |
|---|---|---|---|
| JP | 2005-096290 | A | 4/2005 |
| JP | 2006-150858 | A | 6/2006 |
| JP | 2006-181773 | A | 7/2006 |
| JP | 2012-176498 | A | 9/2012 |

* cited by examiner

*Primary Examiner* — Kristal Feggins
(74) *Attorney, Agent, or Firm* — Banner & Witcoff, Ltd.

(57) ABSTRACT

A printer includes a printing portion, a cover including a first roller, a peeling mechanism including a second roller, and a first guide portion including a moving portion and a first restricting portion. The peeling mechanism is switched among three states. In a first state, the second roller is separated from the first roller. In a third state, the second roller is in contact with the first roller. In a second state, the distance between the first roller and the second roller is less than the distance between the first roller and the second roller in the first state. The moving portion switches the peeling mechanism from the first state to the second state as the cover changes from an open state to a closed state. The first restricting portion restricts the switching of the peeling mechanism from the third state to the second state.

7 Claims, 17 Drawing Sheets

PRINTER

CROSS-REFERENCE TO RELATED APPLICATION

This application claims priority to Japanese Patent Application No. 2014-038940 filed Feb. 28, 2014, the content of which is hereby incorporated herein by reference.

BACKGROUND

The present disclosure relates to a printer that is provided with a peeling mechanism that peels a printed label off of a release paper.

A printer is known that is able to switch between two different operating modes of normal printing and peel-off printing. Normal printing is an operating mode in which a printed label is discharged in a state in which it is affixed to a release paper. Peel-off printing is an operating mode in which the printed label is discharged in a state in which it has been peeled off of the release paper. A label printer that is a printer that is able to switch between normal printing and peel-off printing is provided with a peeling unit that includes a pinch roller and a torsion spring. The peeling unit is able to move such that the pinch roller is separated from a platen roller during normal printing and is in contact with the platen roller during peel-off printing. During peel-off printing, the pinch roller is pressed against the platen roller by the energizing force of the torsion spring. The platen roller and the pinch roller rotate in a state in which the release paper is pinched between the platen roller and the pinch roller, and they bend the release paper such that the side of the release paper to which the label is not affixed faces each other. By bending the release paper, the peeling unit peels the printed label off of the release paper. Note that in order for the printed label to be peeled off of the release paper properly, it is preferable for the pinch roller to make proper contact with the platen roller.

SUMMARY

In the label printer configuration that is described above, the pinch roller is pressed against the platen roller by the energizing force of the torsion spring. With this configuration, if the energizing force of the torsion spring decreases, the contact between the pinch roller and the platen roller will be insufficient in some cases. Furthermore, with this configuration, if the energizing force of the torsion spring is increased to cause the pinch roller and the platen roller to make contact more reliably, a user may be unable to easily perform the operation of switching the operating mode. The reason for this is that, in a case where the user switches the operating mode from peel-off printing to normal printing, a strong force is required in order to separate the pinch roller from the platen roller against the energizing force of the torsion spring. Thus, in the label printer that is described above, it is difficult to make it possible both to peel the printed label off of the release paper properly and to switch the operating mode easily.

Various embodiments of the broad principles derived herein provide a printer that can easily be switched to an operating mode in which the label is discharged in a state in which it has been peeled off of the release paper and that can peel the label off of the release paper properly.

The printer according to the present disclosure includes a printing portion, a cover, a peeling mechanism, and a first guide portion. The printing portion performs printing on a label. The cover is provided with a first roller and is configured to open and close a storing portion. The storing portion contains a roll around which is wound a release paper to which the label is affixed. The peeling mechanism is provided with a second roller and a projecting portion. The peeling mechanism is configured to be switched among a first state, a second state, and a third state. The first state is a state in which the second roller is separated from the first roller. The third state is a state in which the second roller is in contact with the first roller. The second state is a state in which the distance between the first roller and the second roller is less than the distance between the first roller and the second roller in the first state and greater than the distance between the first roller and the second roller in the third state. The first guide portion is provided in the cover and includes a moving portion and a first restricting portion. The moving portion is configured to switch the peeling mechanism from the first state to the second state by moving the projecting portion as the cover changes from an open state to a closed state. The first restricting portion is configured to restrict the switching of the peeling mechanism from the third state to the second state by restricting the movement of the projecting portion.

BRIEF DESCRIPTION I/F THE DRAWINGS

Embodiments will be described below in detail with reference to the accompanying drawings in which.

Figure 16:
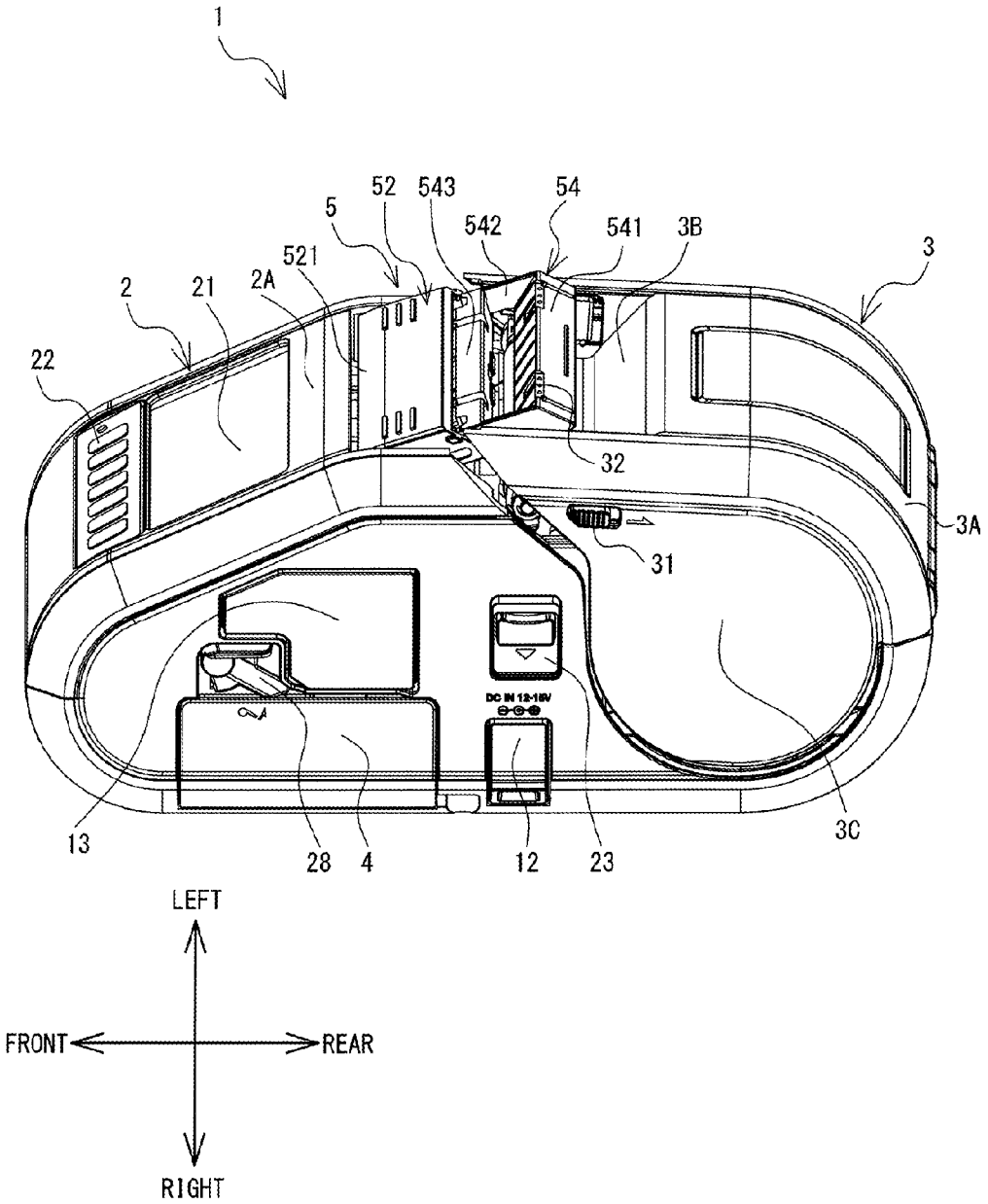
Figure 17:
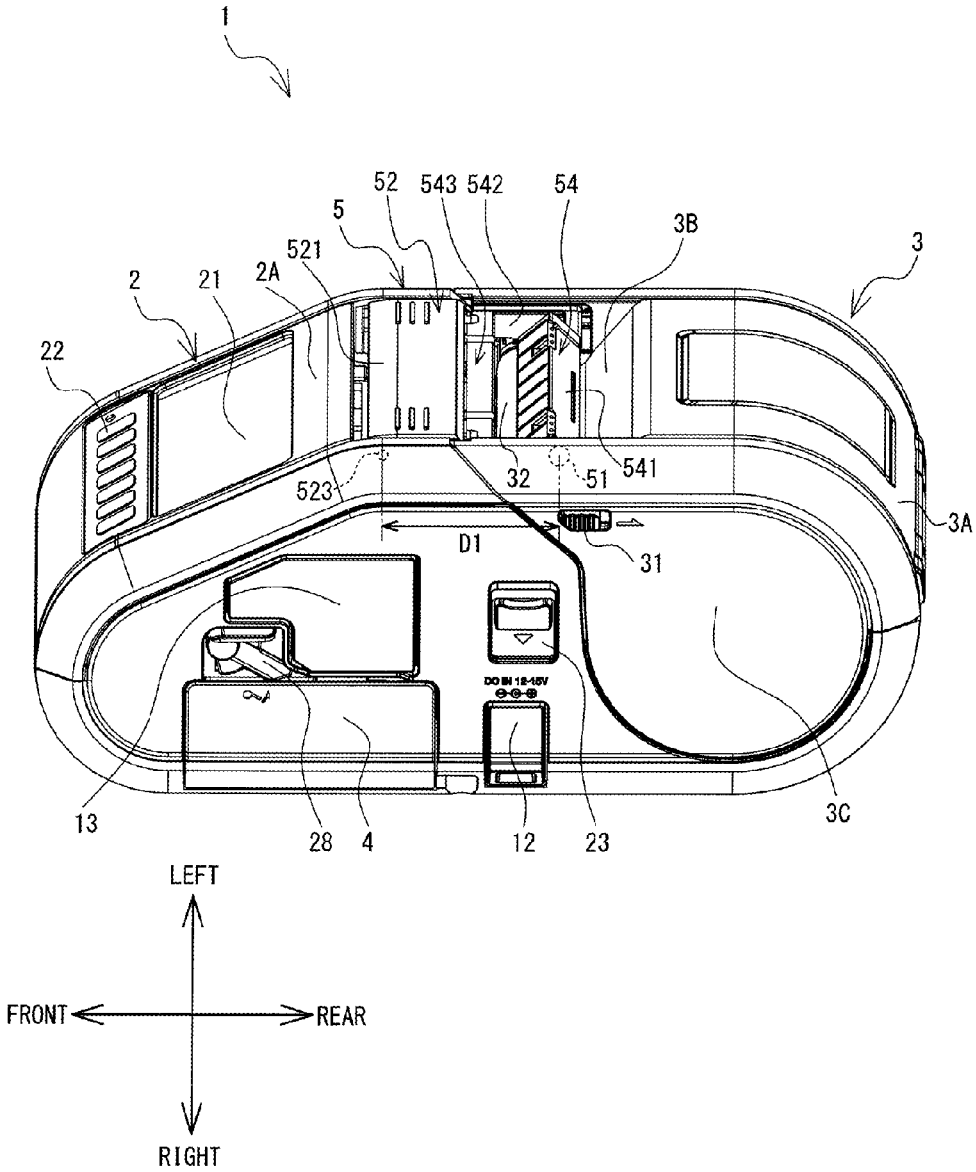

FIG. 16 is an oblique view of the printer 1 (in the state in which the cover 3 is open); and FIG. 17 is an oblique view of the printer 1 (in the state in which the cover 3 is closed).

DETAILED DESCRIPTION

Hereinafter, an embodiment of the present disclosure will be explained with reference to the drawings. Note that the drawings are used for explaining technological features that the present disclosure can utilize. Accordingly, device configurations and the like that are shown in the drawings are merely explanatory examples and do not serve to restrict the present disclosure to those configurations and the like, unless otherwise indicated specifically. A printer 1 can be connected to an external terminal (not shown in the drawings) through a USB (registered trademark) cable. The printer 1 is capable of printing text characters, graphics, and the like on a printing medium, based on printing data that the printer 1 receives from the external terminal. The printing medium is a heat-sensitive label. The external terminal is a general-purpose personal computer (PC). The lower right side, the upper left side, the upper right side, the lower left side, the top side, and the bottom side in FIG. 1 respectively define the right side, the left side, the rear side, the front side, the top side, and the bottom side of the printer 1.

Overview of Printer 1

Figure 1:
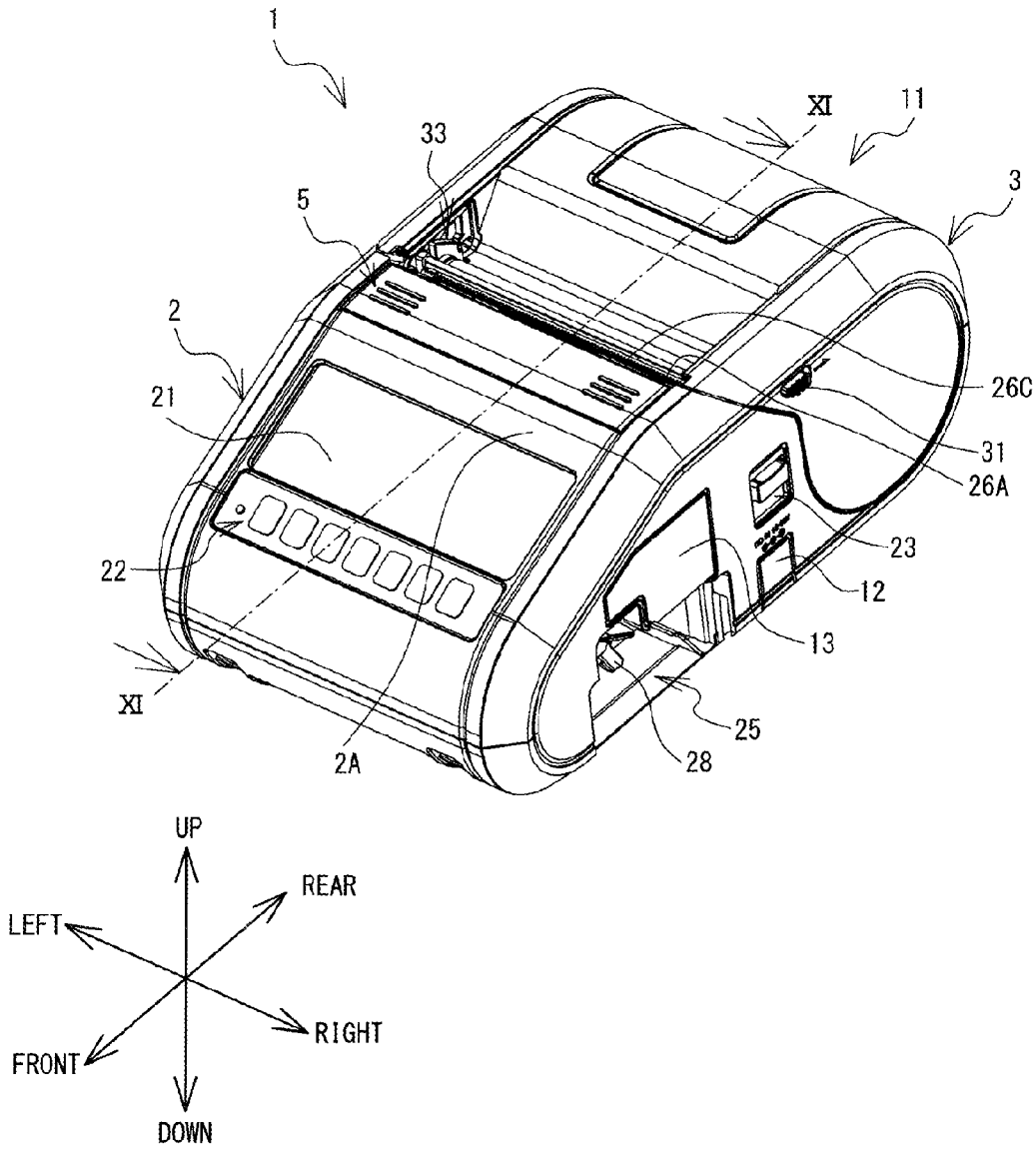
FIG. 1 is an oblique view of a printer 1 (in a state in which a cover 3 is closed)

An overview of the printer 1 will be explained with reference to FIGS. 1 and 2. The printer 1 is provided with a body 2. The body 2 is provided with a control portion (not shown in the drawings), a printing portion 26B, a drive portion (not shown in the drawings), and the like in its interior. The control portion includes a CPU that controls the entire printer 1. The printing portion 26B is a line thermal head that is capable of performing printing on a heat-sensitive label. The drive portion is a motor for conveying the heat-sensitive label. The body 2 is provided with a display portion 21 and a switch 22 on an inclined portion 2A toward the front of the top side. The body 2 is provided with a peeling mechanism 5 to the rear of the display portion 21 on the inclined portion 2A. The body 2 is provided with a storing portion 24 to the rear of the peeling mechanism 5. On its right side, the body 2 is provided with an electric power supply portion 12, a USB (registered trademark) interface (I/F) 13, a lever 23, a storing portion 25, a body securing portion 28, and the like.

The storing portion 24 is able to contain a roll (not shown in the drawings) around which is wound a release paper to which a heat-sensitive label is affixed. Hereinafter, the release paper and the heat-sensitive label will be called the tape. The left and right sides and the top side of the storing portion 24 are open. A form holder 9 is fixed in place inside the storing portion 24. The form holder 9 holds the roll. A cutting portion 26A is provided on the upper edge of a wall on the front side of the storing portion 24. The printing portion 26B is provided below the cutting portion 26A. The cutting portion 26A is a cutting edge that is able to cut away the printed portion of the tape. The cutting portion 26A and the printing portion 26B extend in the left-right direction. A pair of engaging portions 241 project toward the rear from the left and right ends of the wall on the front side of the storing portion 24. Each one of the pair of the engaging portions 241 is provided with a first extending portion that extends upward and a second extending portion that extends toward the front from the upper end of the first extending portion. Each one of the pair of the engaging portions 241 is able to pivot, with its lower end serving as a stationary support. When the lever 23 is pressed downward, each one of the pair of the engaging portions 241 pivots such that the upper end of its first extending portion moves toward the rear.

A cover 3 is supported by a support shaft 29 that is provided on the rear edge of the storing portion 24, such that the cover 3 can pivot around the support shaft 29. The cover 3 can pivot to anchor position where it covers the storing portion 24 from above and from the right side and the left side. Energizing portions 29A are wound around the support shaft 29. The energizing portions 29A are springs. The energizing portions 29A energize the cover 3 from a state in which it covers the storing portion 24 toward a state in which it does not cover the storing portion 24. Hereinafter, the state in which the cover 3 covers the storing portion 24 will be called the closed state of the cover 3, and the state in which the cover 3 does not cover the storing portion 24 will be called the open state of the cover 3.

The edge of the cover 3 that is on the opposite side from the edge that is supported by the support shaft 29, that is, the front edge of the cover 3 in its closed state, supports a first roller 32 such that the first roller 32 can rotate. A rotating shaft of the first roller 32 extends in the left-right direction. A pair of engaged portions 321 extend outward to the left and the right from the left and right ends, respectively, of the rotating shaft of the first roller 32. Each one of the pair of the engaged portions 321 has a circular cylindrical shape. A gear 36 is provided on the left side of the engaged portion 321 on the left side. In the closed state of the cover 3, each one of the pair of the engaged portions 321 engages with the second extending portion of the corresponding one of the pair of the engaging portions 241. At this time, the pivoting of the cover 3 from the closed state to the open state is inhibited by the engaging portions 241, and the closed state of the cover 3 is maintained.

In the closed state of the cover 3, the printing portion 26B and the first roller 32 are close to one another. In the closed state of the cover 3, a discharge outlet 26C, from which the tape is discharged, is formed between the peeling mechanism 5 and the first roller 32. In the closed state of the cover 3, the gear 36 meshes with a gear 76 (refer to FIGS. 8 and 9) that is provided in the body 2. The gear 76 is coupled to the drive portion of the body 2 and is able to rotate. In the closed state of the cover 3, when the gear 76 rotates, the gear 36 and the first roller 32 rotate in accordance with the rotation of the gear 76.

In the closed state of the cover 3, when the lever 23 is pressed downward, the engaged portions 321 are released from the second extending portions of the engaging portions 241. The cover 3 is pivoted from the closed state to the open state by the energizing force of the energizing portions 29A.

The electric power supply portion 12 is a terminal for inserting a plug of an AC adaptor. The USB (registered trademark) I/F 13 includes a plurality of terminals for inserting connectors of a USB cable. The printer 1 is able to perform communication with the external terminal through the USB I/F 13. Note that in FIGS. 1 and 2, the electric power supply portion 12 and the USB I/F 13 are covered by rubber covers. The storing portion 25 is able to contain a battery (not shown in the drawings). The printer 1 can be driven by electric power that is supplied by the electric power supply portion 12 and by electric power that is supplied by the battery that is contained in the storing portion 25. Furthermore, the printer 1 can use the electric power that is supplied from the electric power supply portion 12 to charge the battery that is contained in the storing portion 25. The body securing portion 28 holds the battery that is contained in the storing portion 25 such that the battery does not come out of the body 2. The lever 23, the electric power supply portion 12, the USB I/F 13, and the storing portion 25 are disposed in a cluster on the right side face of the printer 1. A user is therefore able to easily perform the operations of the printer 1 that are performed through the lever 23, the electric power supply portion 12, the USB I/F 13, and the storing portion 25.

An overview of a case in which printing is performed on the heat-sensitive label will be explained. The roll is held in the form holder 9, and the cover 3 is closed. The tape from the roll is passed upward between the printing portion 26B and the first roller 32 from below. The first roller 32 presses the tape against the printing portion 26B with a specified force. The rotating of the first roller 32 in conjunction with the operating of the drive portion causes the tape to be continuously fed off of the roll and conveyed upward from below. At the same time, a heating element of the printing portion 26B generates heat. Text characters and graphics are printed on the heat-sensitive label by the heat-generating heating element. After the printing, the tape is discharged to the outside from the discharge outlet 26C, in a state in which the heat-sensitive label is affixed to the release paper. The discharged tape is cut by the cutting portion 26A.

Note that, as will be described in detail later, by using the peeling mechanism 5, the printer 1 is able to discharge the tape to the outside from the discharge outlet 26C while peeling the printed heat-sensitive label off of the release paper. Hereinafter, the operating mode in which the printed heat-sensitive label is discharged to the outside in a state in which it is affixed to the release paper will be called the normal mode. The operating mode in which the printed heat-sensitive label is discharged from the storing portion 24 while being peeled off of the release paper will be called the peel-off mode.

Cover 3, First Guide Portions 331, Second Guide Portions 332

Figure 3:
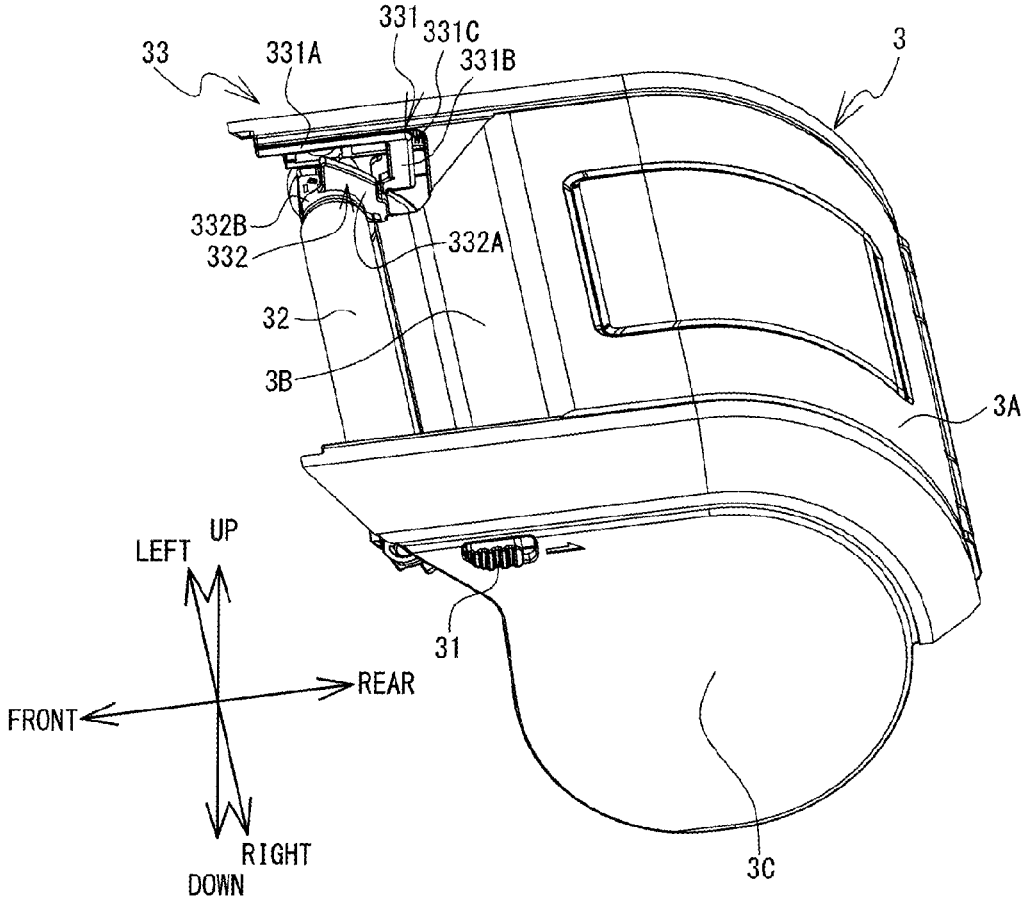
FIG. 3 is an oblique view of the cover 3.

The cover 3 will be explained in detail with reference to FIG. 3. The cover 3 is provided with a plate-shaped first member 3A, a second member 3B, and a pair of third members 3C. The first member 3A extends in a curved shape from a portion that is supported by the support shaft 29. The second member 3B extends in a straight line toward the center of curvature of the first member 3A from the side of the first member 3A that is opposite the side that is supported by the support shaft 29. The pair of the third members 3C are provided opposite one another on the left and right edges of the first member 3A and the second member 3B. When the cover 3 is in the closed state, the first member 3A and the second member 3B cover the opening on the top side of the storing portion 24 of the body 2. When the cover 3 is in the closed state, the pair of the third members 3C cover the openings on the left and right sides of the storing portion 24 of the body 2.

The explanation that follows will use the closed state of the cover 3 as an example. The pair of the third members 3C support the first roller 32 from the left and the right at the front side of the second member 3B. Each one of the pair of the third members 3C is provided with a first guide portion 331 close to the portion that supports the first roller 32. Hereinafter, the first guide portion 331 that is provided on the third member 3C on the left side will be explained. The first guide portion 331 is provided with a bar-shaped moving portion 331A, a first restricting portion 331B, and a first energizing portion 331C. The moving portion 331A extends in a straight line in the front-rear direction above the left end of the first roller 32. The first restricting portion 331B extends downward in a straight line from the rear end of the moving portion 331A. The lower end of the first restricting portion 331B projects slightly toward the front. The tip of the projecting portion of the first restricting portion 331B is close to and to the rear of the rear edge of an extending portion 332A of a second guide portion 332, which will be described later. The first guide portion 331 is able to move toward the front and the rear. The first energizing portion 331C is provided on the rear side of the first restricting portion 331B. The first energizing portion 331C is a compression spring that energizes the first guide portion 331 toward the front. The first guide portion 331 is connected to a lever 31 that is provided on the left face of the third member 3C on the left side. When the lever 31 is moved toward the rear, the first guide portion 331 moves toward the rear against the energizing force of the first energizing portion 331C. The lower end of the first restricting portion 331B thus moves away from the extending portion 332A of the second guide portion 332.

Note that the first guide portion 331 that is provided in the third member 3C on the right side has the same shape as that described above, although it will not be described in detail.

The second guide portions 332 are provided at the left and right ends of the first roller 32, close to the corresponding ones of the pair of the third members 3C. Hereinafter, the second guide portion 332 that is provided at the left end of the first roller 32 will be explained. The second guide portion 332 includes the extending portion 332A and an anchoring portion 332B. The anchoring portion 332B is provided to the left of the left end of the first roller 32. The anchoring portion 332B has a circular cylindrical shape whose cross-sectional shape is substantially the same as that of the first roller 32. The axial center of the anchoring portion 332B extends in the same direction as the rotational axis of the first roller 32. The extending portion 332A is a plate-shaped member that extends outward from the top side to the rear side of a circumferential wall of the anchoring portion 332B. The edge of the extending portion 332A on the opposite side from the anchoring portion 332B slopes downward toward the rear. The rear edge of the edge of the extending portion 332A on the opposite side from the anchoring portion 332B is close to the lower end of the first restricting portion 331B of the first guide portion 331.

Peeling Mechanism 5

Figure 4:
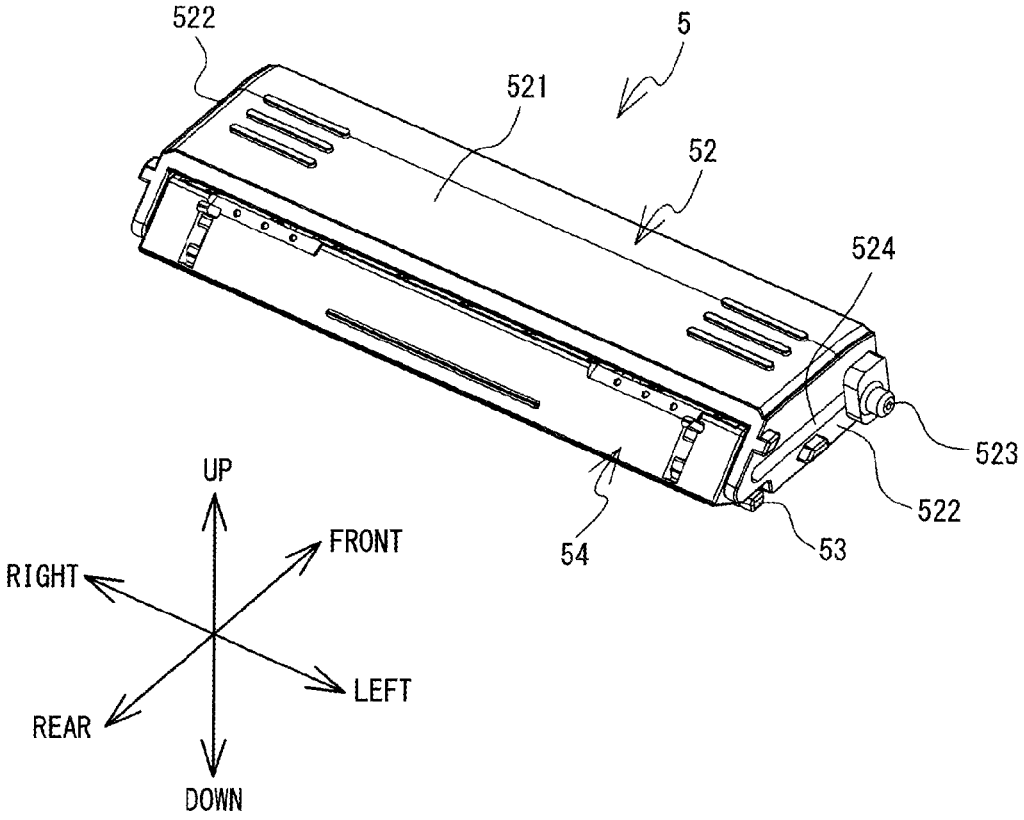
FIG. 4 is an oblique view of a peeling mechanism 5 in a stored state, as seen from above.
Figure 5:
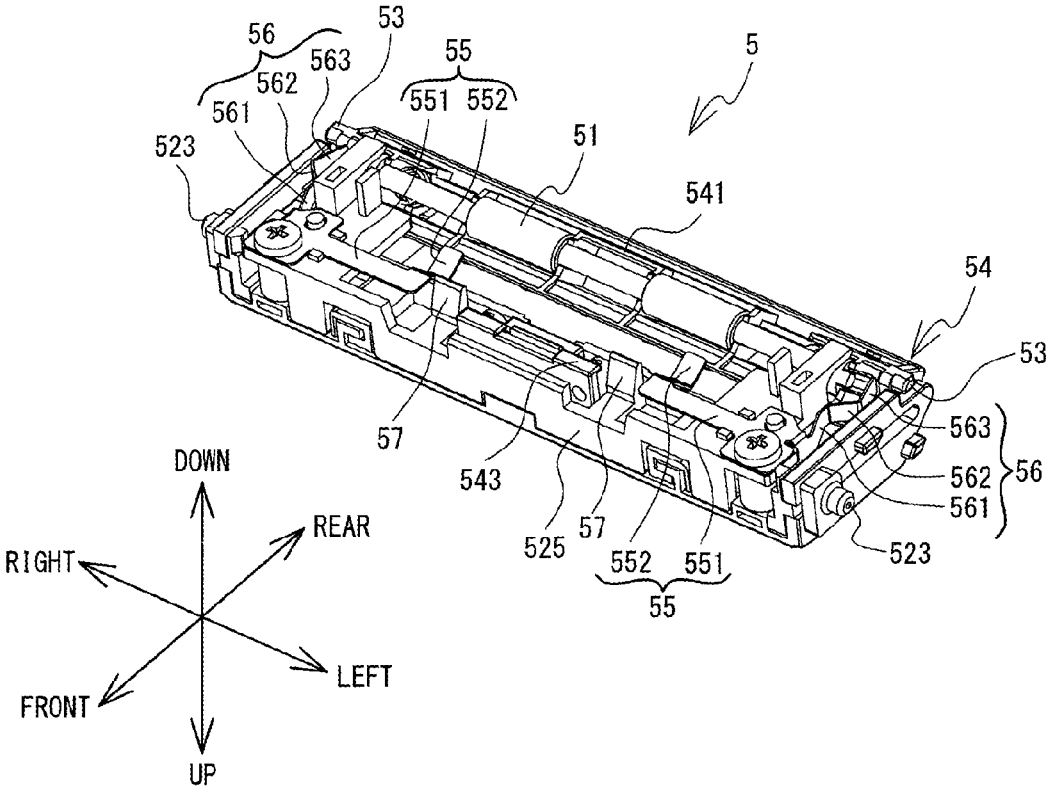
FIG. 5 is an oblique view of the peeling mechanism 5 in the stored state, as seen from below.

The peeling mechanism 5 will be explained in detail with reference to FIGS. 4 to 7. As shown in FIG. 4, the peeling mechanism 5 is provided with a frame 52. The frame 52 has a plate-shaped first member 521, a pair of second members 522, and a third member 525. The shape of the first member 521 is a rectangle whose longitudinal axis extends in the left-right direction. The pair of the second members 522 extend downward from the left and right ends of the first member 521. Circular cylindrical shaft portions 523 that protrude outward to the left and right are provided at the front ends of the pair of the second members 522. The shaft portions 523 support the peeling mechanism 5 on the body 2 (refer to FIG. 2) such that the peeling mechanism 5 can pivot. The explanation that follows uses a case in which the peeling mechanism 5 has pivoted to a state in which the plane of the first member 521 is horizontal (refer to FIG. 1) as an example. Each one of the pair of the second members 522 is provided with a long hole 524 that passes through the second member 522 in the left-right direction. In each one of the pair of the second members 522, the long hole 524 extends from near the front edge to near the rear edge. As shown in FIG. 5, the third member 525 is provided below the first member 521. On each of its left and right end portions, the third member 525 supports a second restricting portion 55 and a third restricting portion 56, which will be described below. The third member 525 has a pair of anchoring portions 57 that project downward.

Figure 6:
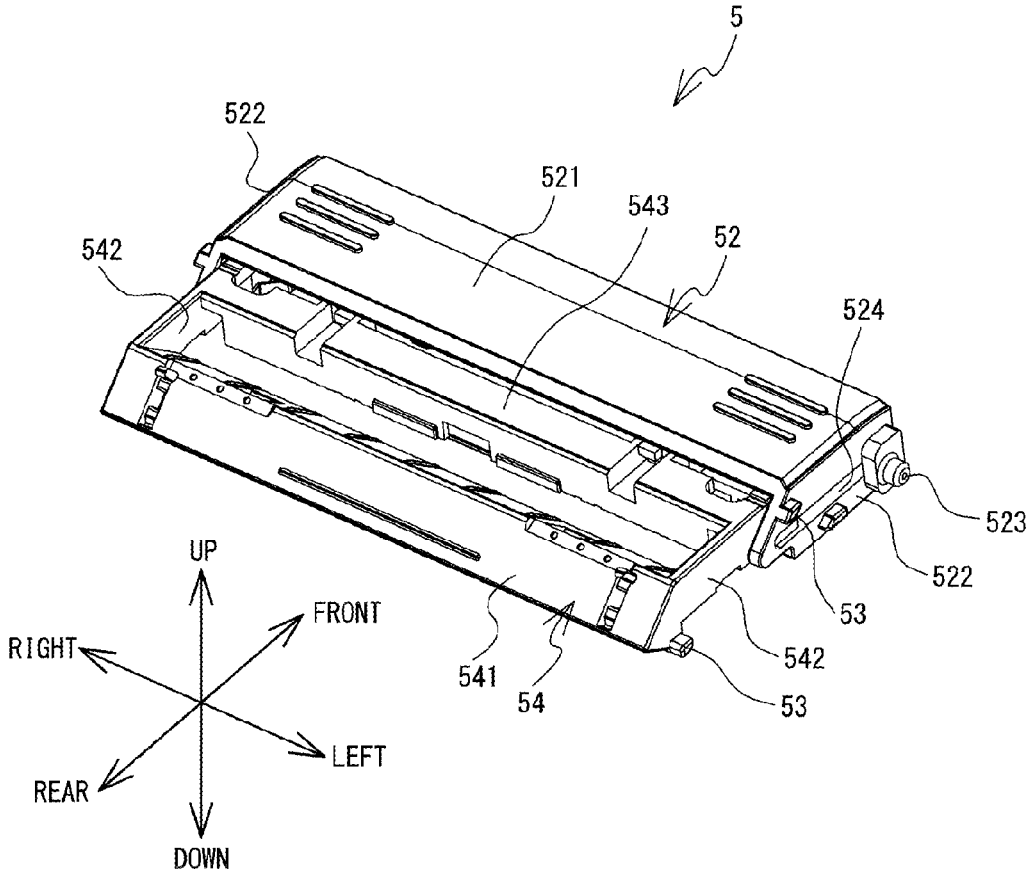
FIG. 6 is an oblique view of the peeling mechanism 5 in a protruding state, as seen from above.
Figure 7:
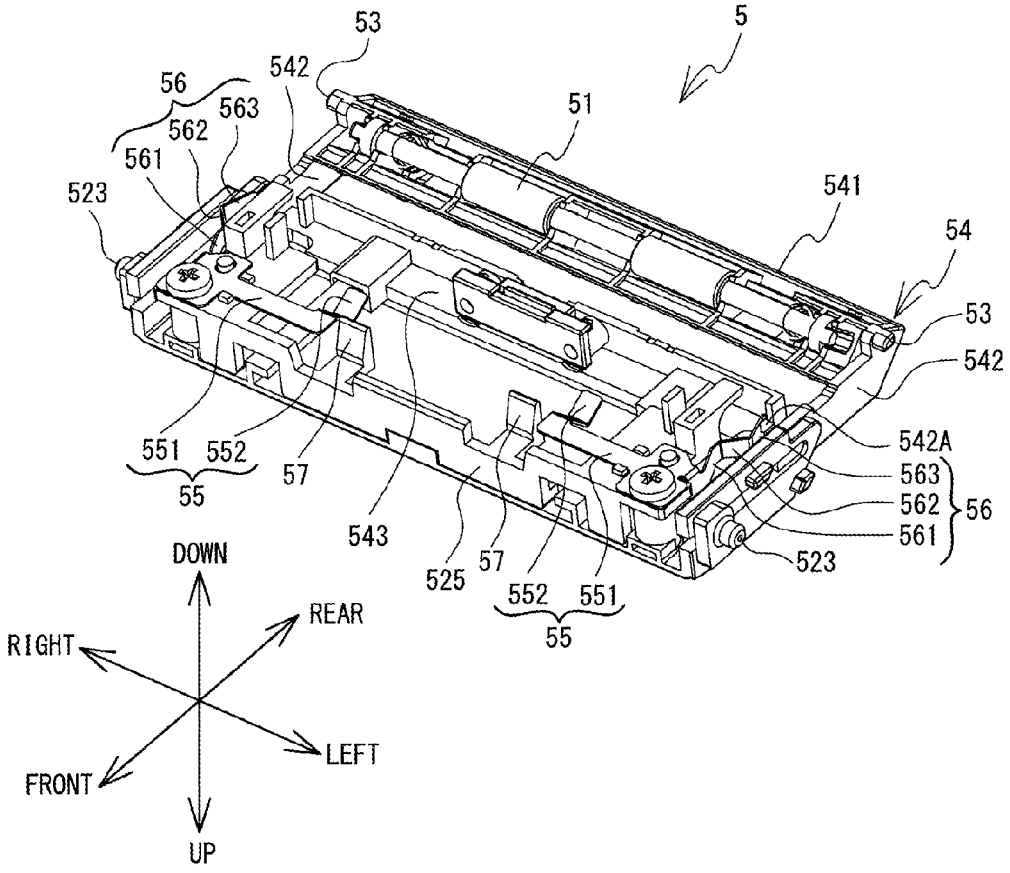
FIG. 7 is an oblique view of the peeling mechanism 5 in the protruding state, as seen from below.

As shown in FIGS. 5 to 7, the pair of the second restricting portions 55 are provided below the first member 521. Each one of the pair of the second restricting portions 55 is provided with a plate-shaped first extending portion 551 and a second extending portion 552. The first extending portions 551 and the second extending portions 552 have upward-facing flat surfaces and downward-facing flat surfaces. The first extending portion 551 of the second restricting portion 55 on the left side is affixed to the third member 525 at the front left corner of the first member 521, in a position where it is below and not in contact with the first member 521. The first extending portion 551 of the second restricting portion 55 on the left side extends horizontally to the right as far as the left side of the anchoring portion 57 on the left side. The second extending portion 552 of the second restricting portion 55 on the left side extends upward toward the rear from the right end of the first extending portion 551, and the tip of the second extending portion 552 is bent such that it extends downward toward the rear. The first extending portion 551 of the second restricting portion 55 on the right side is affixed to the third member 525 at the front right corner of the first member 521, in a position where it is below and not in contact with the first member 521. The first extending portion 551 of the second restricting portion 55 on the right side extends horizontally to the left as far as the right side of the anchoring portion 57 on the right side. The second extending portion 552 of the second restricting portion 55 on the right side extends upward toward the rear from the left end of the first extending portion 551, and the tip of the second extending portion 552 is bent such that it extends downward toward the rear. Each one of the pair of the second restricting portions 55 is able to deform elastically in a direction in which the corresponding second extending portion 552 moves downward.

The pair of the third restricting portions 56 are also provided below the first member 521. Each one of the pair of the third restricting portions 56 is provided with a plate-shaped first extending portion 561, a second extending portion 562, and a third extending portion 563. The first extending portions 561, the second extending portions 562, and the third extending portions 563 have left-facing flat surfaces and right-facing flat surfaces. The third restricting portion 56 on the left side is disposed to the right of the second member 522 on the left side of the frame 52, and the third restricting portion 56 on the right side is disposed to the left of the second member 522 on the right side of the frame 52.

The first extending portion 561 of the third restricting portion 56 on the left side extends toward the right rear from the front left corner of the first member 521, from a position that is close to and above the left end of the second restricting portion 55 on the left side. The second extending portion 562 of the third restricting portion 56 on the left side extends toward the left rear from the rear end of the first extending portion 561. The third extending portion 563 of the third restricting portion 56 on the left side extends toward the right rear from the rear end of the second extending portion 562. The portion where the second extending portion 562 and the third extending portion 563 are connected in the third restricting portion 56 on the left side is close to a left-side one of a pair of second members 542 (refer to FIGS. 6 and 7) that will be described later. The first extending portion 561 of the third restricting portion 56 on the right side extends toward the left rear from the front right corner of the first member 521, from a position that is close to and above the right end of the second restricting portion 55 on the right side. The second extending portion 562 of the third restricting portion 56 on the right side extends toward the right rear from the rear end of the first extending portion 561. The third extending portion 563 of the third restricting portion 56 on the right side extends toward the left rear from the rear end of the second extending portion 562. The portion where the second extending portion 562 and the third extending portion 563 are connected in the third restricting portion 56 on the right side is close to a right-side one of the pair of the second members 542 that will be described later. Each one of the pair of the third restricting portions 56 is able to deform elastically in a direction in which the corresponding second extending portion 562 and third extending portion 563 move toward the inside in the left-right direction.

As shown in FIGS. 4 and 6, the peeling mechanism 5 is also provided with a support portion 54. The support portion 54 is provided with a first member 541, the pair of the second members 542, and a third member 543. The first member 541 extends in the left-right direction. The length of the first member 541 in the left-right direction is slightly shorter than the length of the first member 521 of the frame 52 in the left-right direction. Below the first member 541 a space is formed that extends in the left-right direction and is open on its bottom side. As shown in FIGS. 5 and 7, a second roller 51 is provided in the space below the first member 541. The second roller 51 is a circular cylinder, and it extends in the left-right direction. The left and right ends of the second roller 51 are supported by the first member 541 such that the second roller 51 is able to rotate.

The pair of the second members 542 are plate-shaped members that extend toward the front from the left and right ends of the first member 541. The lengths of the pair of the second members 542 in the front-rear direction are substantially the same as the lengths of the pair of the second members 522 of the frame 52 in the front-rear direction. At least a portion of the second member 542 on the left side is disposed between the second member 522 on the left side and the third restricting portion 56 on the left side. At least a portion of the second member 542 on the right side is disposed between the second member 522 on the right side and the third restricting portion 56 on the right side. A projecting portion that projects toward the outside in the left-right direction and that is not shown in the drawings is provided in the front end portion of the outer side face of each one of the pair of the second members 542. Each one of the projecting portions is inserted from the inner side into the long hole 524 in the corresponding one of the pair of the second members 522 of the frame 52. Each one of the two projecting portions is able to move toward the front and the rear along the corresponding long hole 524. The support portion 54 is thus able to move between a state in which it is disposed within a space that is enclosed by the first member 521 and the pair of the second members 522 of the frame 52 (refer to FIGS. 4 and 5) and a state in which it is disposed to the rear of that space (refer to FIGS. 6 and 7). A projecting portion 53 that projects toward the outside in the left-right direction is provided close to the rear end of each one of the pair of the second members 542. A projecting portion 542A (refer to FIG. 7) that projects toward the inside in the left-right direction is provided on the front end of each one of the pair of the second members 542.

The third member 543 is provided between the pair of the second members 542, to the rear of the centers of the second members 542 in the front-rear direction. The first member 541, the pair of the second members 542, and the third member 543 form an opening on the inner side of the support portion 54.

As shown in FIG. 5, in a case where the support portion 54 is disposed inside the space that is enclosed by the first member 521 and the pair of the second members 522 of the frame 52, the second extending portion 552 of each one of the pair of the second restricting portions 55 passes upward from below through the opening on the inner side of the first member 541, the pair of the second members 542, and the third member 543 of the support portion 54. Each one of the second extending portions 552 is in contact with the rear edge of the third member 543 of the support portion 54 and restricts the movement of the third member 543 toward the rear. The movement of the support portion 54 toward the rear is thus restricted.

Hereinafter, the state in which each one of the second extending portions 552 of the pair of the second restricting portions 55 is in contact with the rear edge of the third member 543 of the support portion 54 (the state that is shown in FIGS. 4 and 5) will be called the stored state. The distance between the shaft portions 523 and the second roller 51 in the stored state will be called the second distance. See D2 in FIG. 15. More specifically, where the direction that is orthogonal to both the axis of the shaft portions 523 and the axis of the second roller 51 is defined as the orthogonal direction, the second distance is the distance in the orthogonal direction between a virtual line that extends along the axis of the shaft portions 523 and a virtual line that extends along the axis of the second roller 51.

In a case where the support portion 54 moves toward the rear, the rear edge of the third member 543, which moves toward the rear together with the support portion 54, comes into contact with the front edges of the pair of the second extending portions 552. Moreover, when the support portion 54 moves toward the rear, the elastic deformation of each one of the pair of the second restricting portions 55 causes the third member 543 to move each one of the second extending portions 552 downward, making it possible to move the third member 543 of the support portion 54 to the rear of the second extending portions 552. It thus becomes possible for the support portion 54 to move toward the rear. A case in which the support portion 54 in the stored state has been moved toward the rear and the third member 543 of the support portion 54 is disposed to the rear of each one of the second extending portions 552 will be used as an example. In this case, the projecting portion 542A of the second member 542 on the left side is disposed to the left of the portion where the first extending portion 561 and the second extending portion 562 are connected in the third restricting portion 56 on the left side. In addition, the projecting portion 542A of the second member 542 on the right side is disposed to the right of the portion where the first extending portion 561 and the second extending portion 562 are connected in the third restricting portion 56 on the right side. In a case where the support portion 54 has moved farther toward the rear from this state, the second extending portions 562 are in contact with the projecting portions 542A, and the movement of the projecting portions 542A toward the rear is restricted. The movement of the support portion 54 toward the rear is thus restricted. Hereinafter, the state in which the movement of the projecting portions 542A toward the rear is restricted by the second extending portions 562 of the third restricting portions 56 will be called the intermediate state.

In a case where the support portion 54 moves farther toward the rear, the projecting portions 542A, which move toward the rear together with the support portion 54, press against the second extending portions 562. The elastic deformation of third restricting portions 56 allows the second extending portions 562 and the third extending portions 563 to move toward the inside in the left-right direction, making it possible for the projecting portions 542A to move to the rear of the portions where the second extending portions 562 and the third extending portions 563 are connected. It thus becomes possible for the support portion 54 to move toward the rear. A case in which the support portion 54 in the intermediate state has been moved toward the rear and the projecting portions 542A are disposed to the rear of the portions where the second extending portions 562 and the third extending portions 563 are connected will be used as an example. In this case, as shown in FIG. 7, the projecting portion 542A of the second member 542 on the left side is disposed to the rear of the portion where the second extending portion 562 and the third extending portion 563 are connected in the third restricting portion 56 on the left side. In addition, the projecting portion 542A of the second member 542 on the right side is disposed to the rear of the portion where the second extending portion 562 and the third extending portion 563 are connected in the third restricting portion 56 on the right side. The third extending portions 563 are in contact with the projecting portions 542A, and the movement of the projecting portions 542A toward the front is restricted. The movement of the support portion 54 toward the front is thus restricted.

Hereinafter, the state in which the movement of the projecting portions 542A toward the front is restricted by the third extending portions 563 of the third restricting portions 56 (the state that is shown in FIGS. 6 and 7) will be called the protruding state. The distance between the shaft portions 523 and the second roller 51 in the protruding state will be called the first distance. See D1 in FIG. 17. The first distance is greater than the second distance.

Holding Mechanism 7

A holding mechanism 7 will be explained with reference to FIGS. 8 to 13. The holding mechanism 7 holds the peeling mechanism 5 such that the peeling mechanism 5 can move. The holding mechanism 7 is provided with a pair of shaft support portions 71, a pair of second energizing portions 72, a pair of anchoring portions 73, a pair of support portions 74, and the like.

Figure 8:
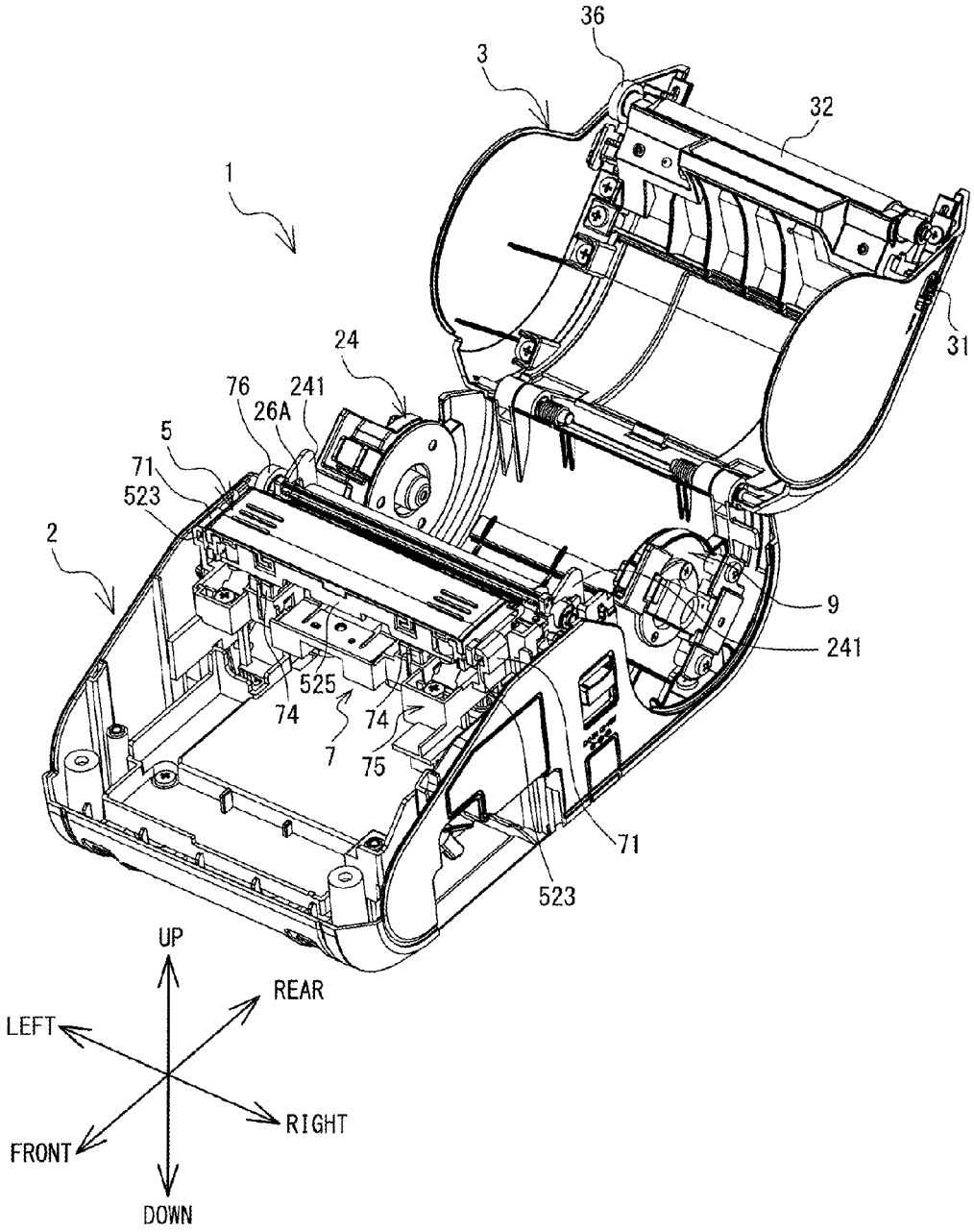
FIG. 8 is an oblique view that shows an internal configuration of the printer 1 (in the state in which the cover 3 is open)
Figure 9:
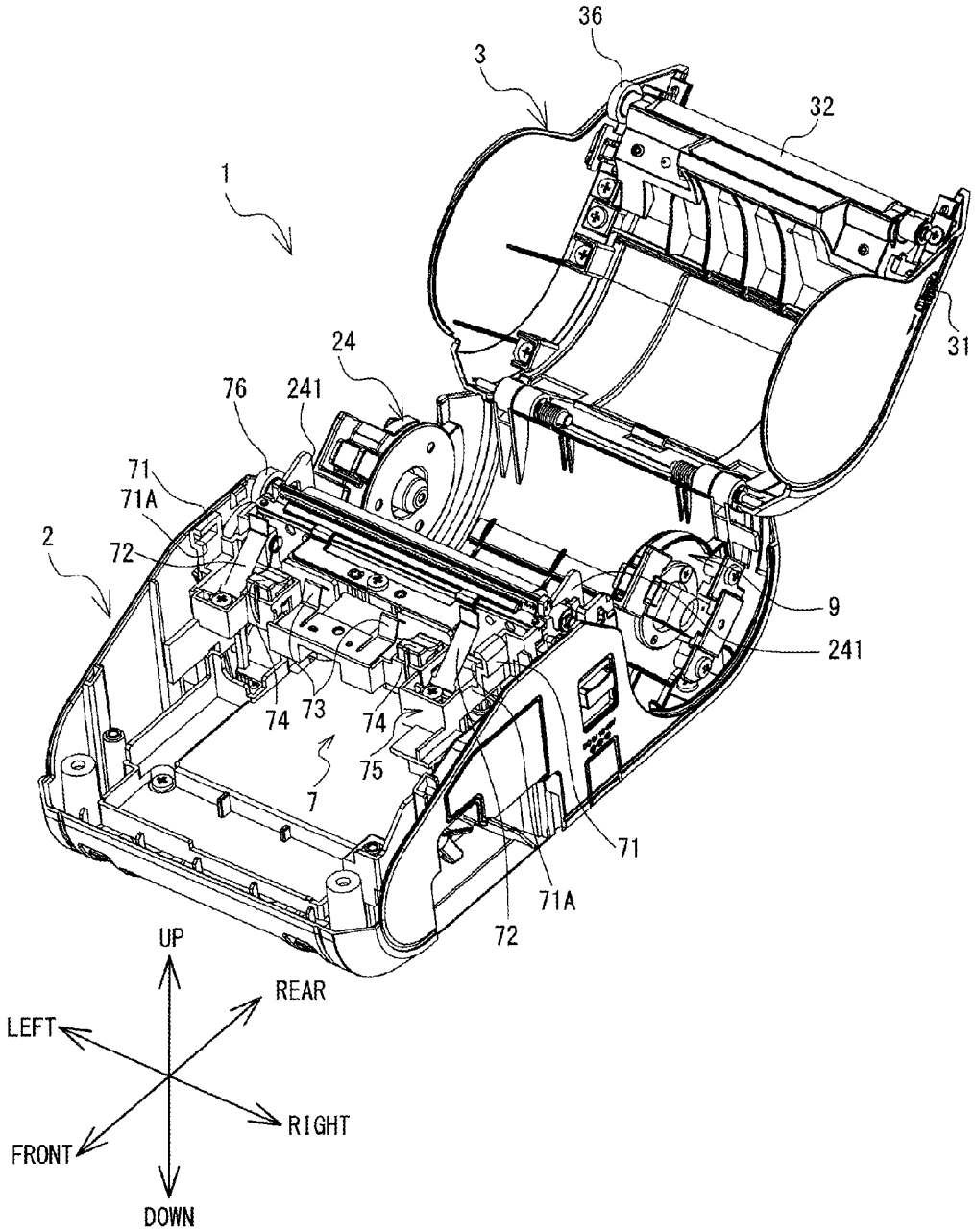
FIG. 9 is an oblique view that shows the internal configuration of the printer 1 (in the state in which the cover 3 is open)

As shown in FIG. 8, the pair of the shaft support portions 71 are provided at the left and right ends of the peeling mechanism 5. As shown in FIG. 9, each one of the pair of the shaft support portions 71 has a groove 71A that extends in the front-rear direction on the inner side of the shaft support portion 71 in the left-right direction. The shaft portion 523 on the left side of the frame 52 of the peeling mechanism 5 is inserted into the groove 71A of the shaft support portion 71 on the left side, and the shaft portion 523 on the right side of the frame 52 of the peeling mechanism 5 is inserted into the groove 71A of the shaft support portion 71 on the right side. The movement of the shaft portions 523 along the grooves 71A of the pair of the shaft support portions 71 makes it possible for the peeling mechanism 5 to move toward the front and the rear. Furthermore, the grooves 71A of the pair of the shaft support portions 71 support the shaft portions 523 such that the shaft portions 523 can rotate, making it possible for the rear side of the peeling mechanism 5 to pivot, with the front edge of the peeling mechanism 5 serving as the pivot point. Note that, as will be described later, when the rear side of the peeling mechanism 5 pivots, sufficient space is required in front of the front edge of the peeling mechanism 5 for the front edge to rotate freely.

Figure 11:
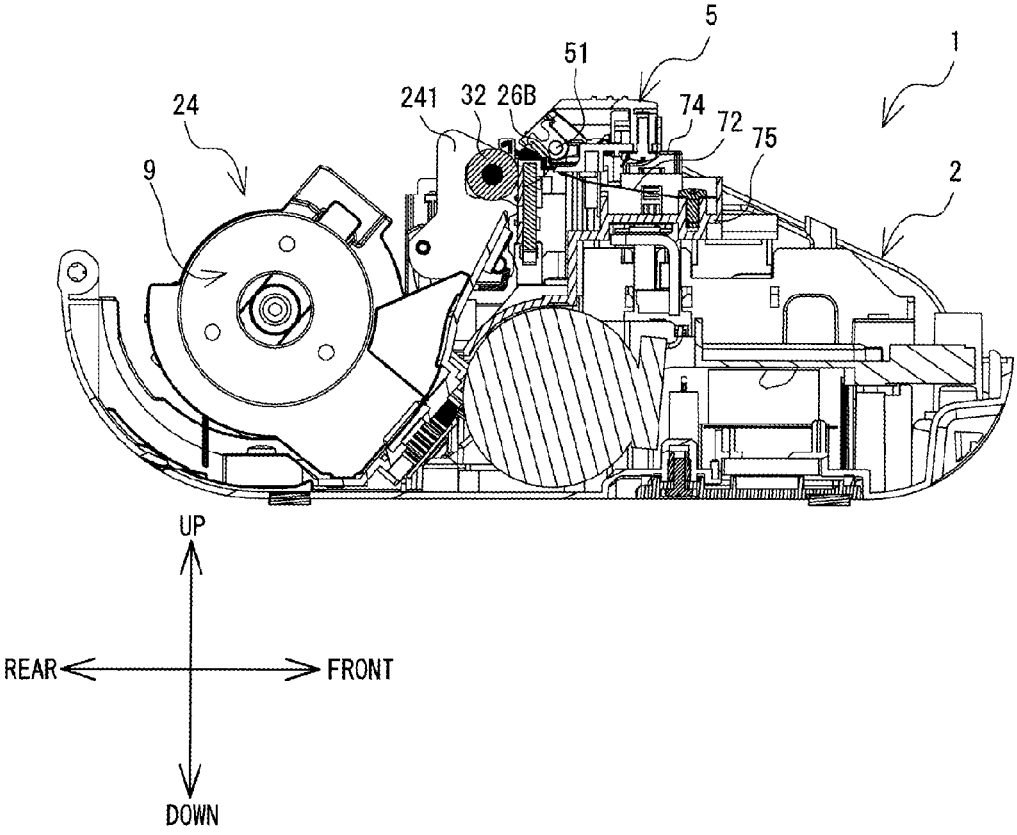
FIG. 11 is a section view of the printer 1 (with the cover 3 omitted) along a line XI-XI in FIG. 1, as seen from the direction indicated by the arrows in FIG. 1.

As shown in FIG. 9, the pair of the second energizing portions 72, the pair of the anchoring portions 73, and the pair of the support portions 74 are provided below the peeling mechanism 5. The pair of the second energizing portions 72 are plate-shaped. The lower ends of the pair of the second energizing portions 72 are affixed to bases 75 that are provided below the peeling mechanism 5. The second energizing portion 72 on the left side extends upward toward the rear from below and to the inside of the shaft support portion 71 on the left side. The second energizing portion 72 on the right side extends upward toward the rear from below and to the inside of the shaft support portion 71 on the right side. As shown in FIG. 11, the upper end of each one of the pair of the second energizing portions 72 is in contact with the rear edge portion of the bottom face of the third member 525 of the peeling mechanism 5. Note that in FIG. 11, the visible outline of the cover 3 has been omitted. Each one of the pair of the second energizing portions 72 energizes the rear edge portion of the peeling mechanism 5 upward.

Figure 10:
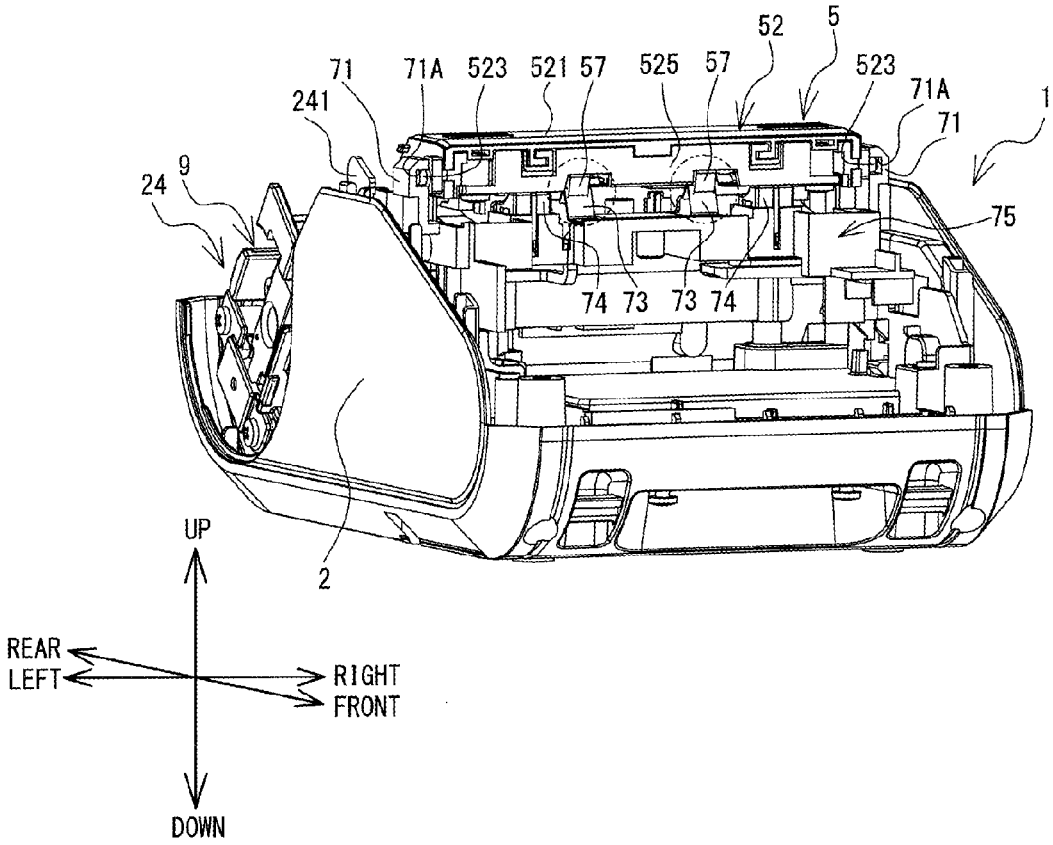
FIG. 10 is an oblique view that shows the internal configuration of the printer 1.

As shown in FIGS. 8 to 10, each one of the pair of the support portions 74 has a three-dimensional rectangular shape with a flat portion and a curved portion on its top face. The support portion 74 on the left side is provided to the right of the second energizing portion 72 on the left side, and the support portion 74 on the right side is provided to the left of the second energizing portion 72 on the right side. As shown in FIGS. 8 and 10 to 12, the top face of the each one of the pair of the support portions 74 is in contact with the front edge portion of the bottom face of the third member 525 of the peeling mechanism 5.

As shown in FIGS. 9 and 10, the pair of the anchoring portions 73 are plate-shaped. The anchoring portion 73 on the left side extends upward toward the rear from a position to the right of the support portion 74 on the left side, then bends at its upper end and extends downward toward the rear. The anchoring portion 73 on the right side extends upward toward the rear from a position to the left of the support portion 74 on the right side, then bends at its upper end and extends downward toward the rear. Each one of the pair of the anchoring portions 73 is able to deform elastically downward.

As shown in FIG. 10, in a case where the peeling mechanism 5 has been moved toward the front by the movement of the shaft portions 523 along the grooves 71A of the shaft support portions 71, the upper end of the each one of the pair of the anchoring portions 73 is disposed on the rear side of the corresponding one of the pair of the anchoring portions 57 that project downward from the frame 52 and is in contact with the corresponding one of the pair of the anchoring portions 57 from the rear. Each one of the pair of the anchoring portions 73 restricts the movement of the corresponding one of the pair of the anchoring portions 57 toward the rear. The peeling mechanism 5 is held in a state (refer to FIG. 1) in which it has moved until the front edge of the peeling mechanism 5 is in contact with the rear edge of the inclined portion 2A of the body 2 (refer to FIG. 1). Note that the peeling mechanism 5 is able to pivot, and its rear edge is energized upward by the pair of the second energizing portions 72. However, because the peeling mechanism 5 is held in the state in which the front edge of the peeling mechanism 5 is in contact with the rear edge of the inclined portion 2A, a space is not formed between the inclined portion 2A and the peeling mechanism 5. Rotation of the front edge of the peeling mechanism 5 is therefore inhibited by inclined portion 2A, so the peeling mechanism 5 is held in a state in which the first member 521 of the frame 52 is horizontal. As shown in FIG. 11, the bottom sides of the front corners of the peeling mechanism 5 are in contact with the front sides of the curved portions of the pair of the support portions 74.

Note that in the state in which the first member 521 of the frame 52 of the peeling mechanism 5 is held in the horizontal state, the user cannot easily switch the peeling mechanism 5 from the stored state, through the intermediate state, to the protruding state. The reason for this is that, in this state, the user cannot easily grip the support portion 54 of the peeling mechanism 5 with his fingers, so the user cannot easily pull the support portion 54 out from the frame 52. Hereinafter, the state in which the peeling mechanism 5 in the stored state has moved toward the front (refer to FIGS. 1 and 10) will be called the fourth state.

Figure 12:
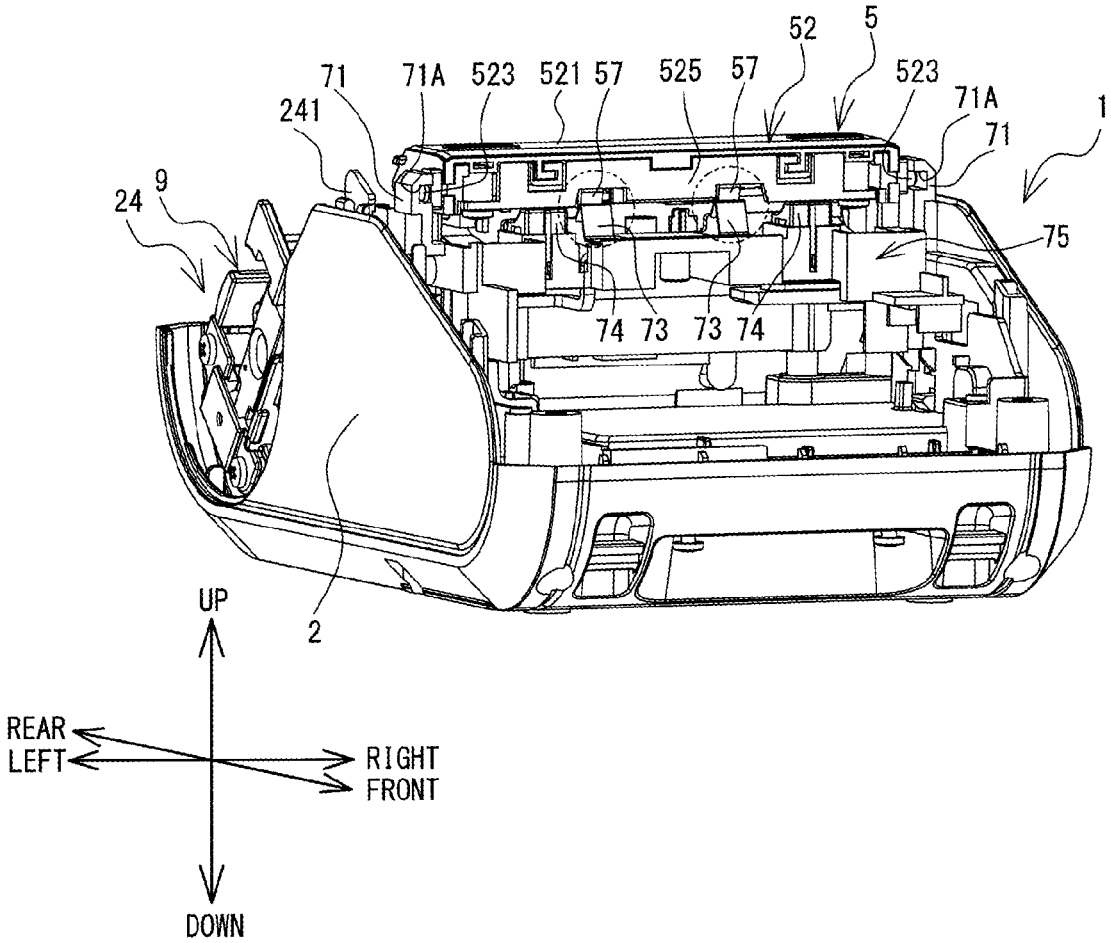
FIG. 12 is an oblique view that shows the internal configuration of the printer 1.
Figure 13:
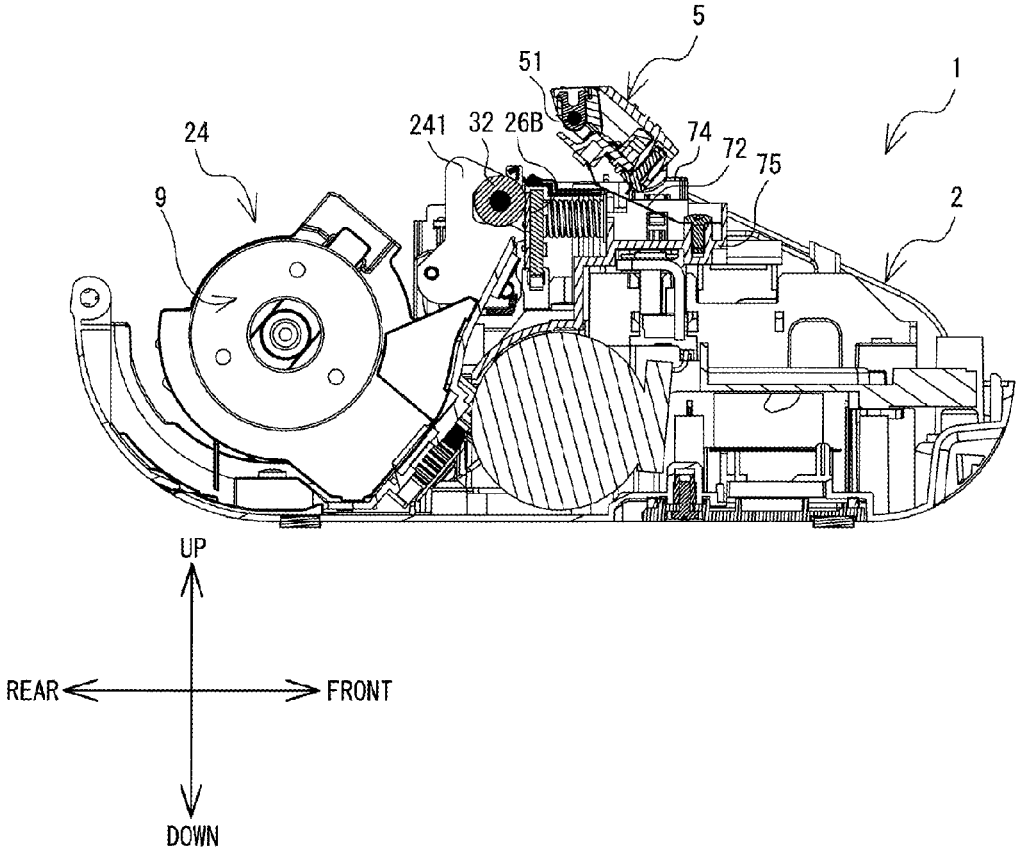
FIG. 13 is a section view of the printer 1 (with the cover 3 omitted) along a line XIII-XIII in FIG. 2, as seen from the direction indicated by the arrows in FIG. 2.

However, the downward elastic deformation of each one of the pair of the anchoring portions 73 makes it possible for the peeling mechanism 5 to move toward the front and the rear. As shown in FIG. 12, in a case where the peeling mechanism 5 has been moved toward the rear by the movement of the shaft portions 523 along the grooves 71A of the shaft support portions 71, the upper end of the each one of the pair of the anchoring portions 73 is disposed on the front side of the corresponding one of the pair of the anchoring portions 57 that project downward from the frame 52. Each one of the pair of the anchoring portions 73 is in contact with the corresponding one of the pair of the anchoring portions 57 from the front. Each one of the pair of the anchoring portions 73 restricts the movement of the corresponding one of the pair of the anchoring portions 57 toward the front. The peeling mechanism 5 is held in a state in which a space has been formed between the rear edge of the inclined portion 2A of the body 2 (refer to FIG. 1) and the front edge of the peeling mechanism 5. Note that the peeling mechanism 5 is able to pivot, and its rear edge is energized upward by the pair of the second energizing portions 72. Therefore, unlike in the fourth state, the peeling mechanism 5 enters a state in which its front edge can rotate. Accordingly, as shown in FIG. 13, the rear edge of the peeling mechanism 5 pivots upward, with the front edge serving as a pivot point. Note that in FIG. 13, the visible outline of the cover 3 has been omitted. In a case where the peeling mechanism 5 pivots, the bottom sides of the front corners of the peeling mechanism 5 move from the front toward the rear along the curved portions of the top faces of the pair of the support portions 74.

In the state in which rear side of the peeling mechanism 5 has pivoted upward, the user can easily switch the peeling mechanism 5 from the stored state, through the intermediate state, to the protruding state. The reason for this is that the user can hook his finger under the support portion 54 of the peeling mechanism 5 and pull the support portion 54 out from the frame 52. Hereinafter, the state in which the rear edge of the peeling mechanism 5 in the protruding state has been pivoted upward (refer to FIG. 2) will be called the first state.

Procedure for Operating the Printer 1 in the Normal Mode

Figure 14:
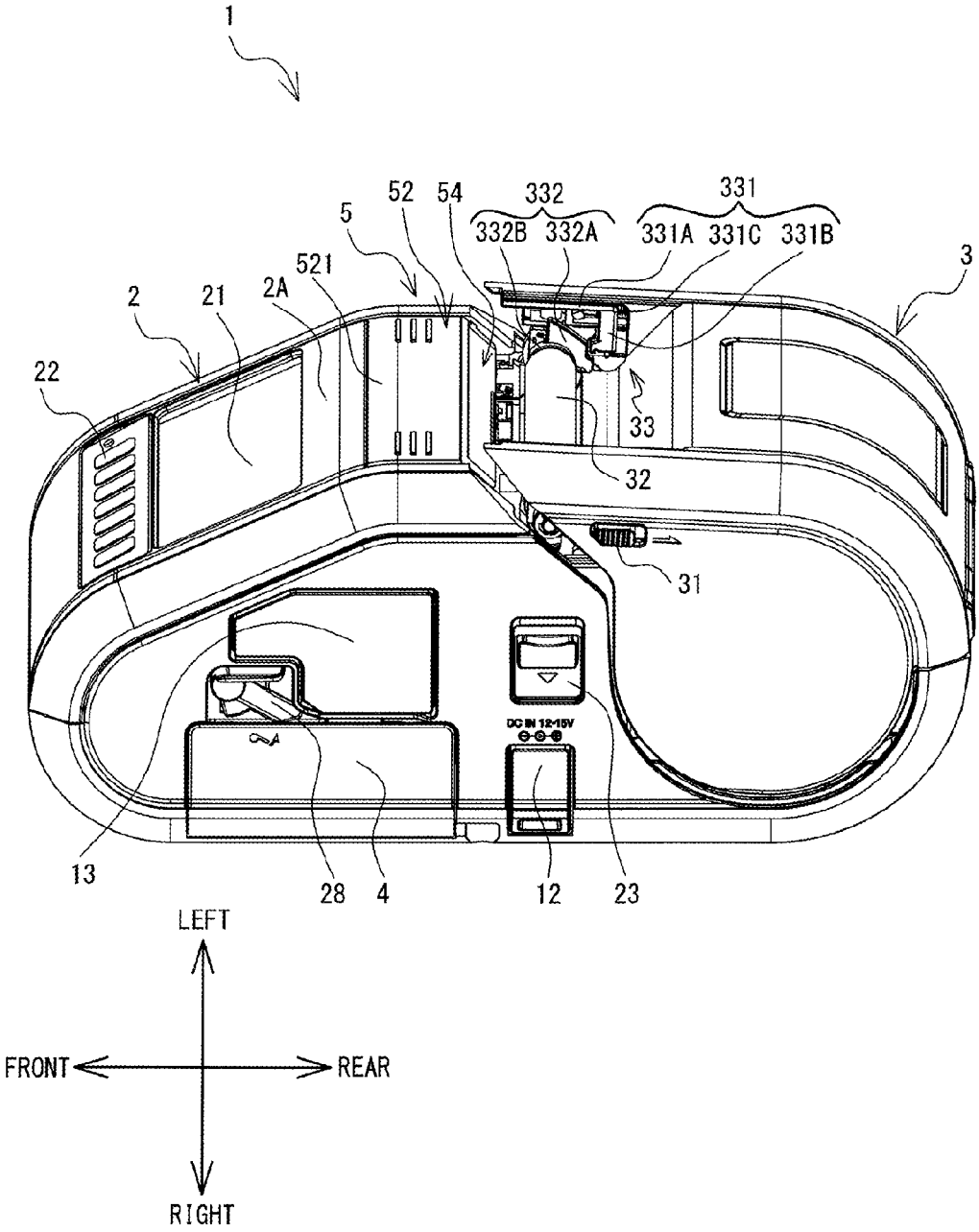
FIG. 14 is an oblique view of the printer 1 (in the state in which the cover 3 is open)
Figure 15:
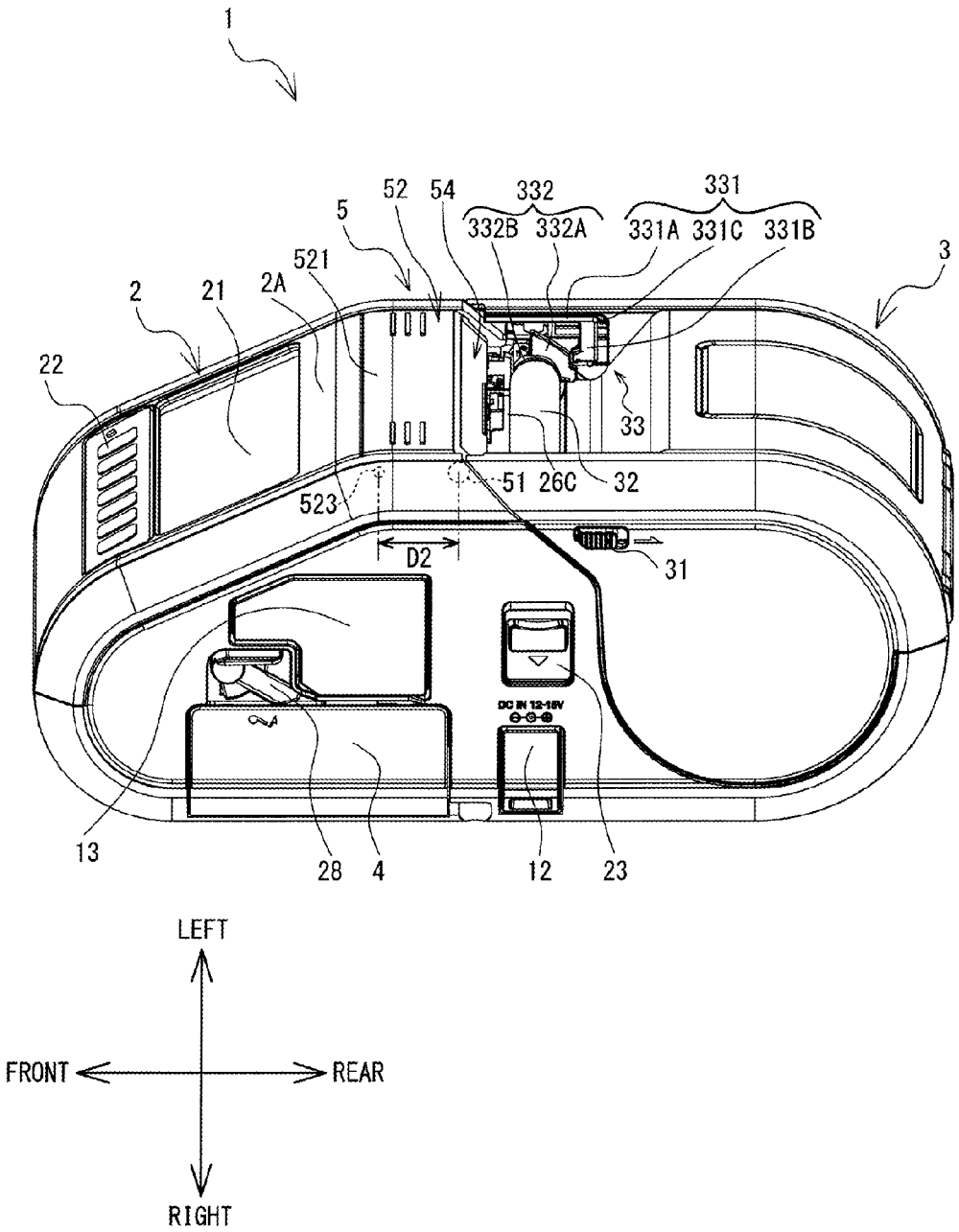
FIG. 15 is an oblique view of the printer 1 (in the state in which the cover 3 is closed)

The procedure for operating the printer 1 in the normal mode will be explained with reference to FIGS. 14 and 15. The user presses the lever 23 downward and disengages the engaged portions 321 (refer to FIG. 2) from the engaging portions 241 (refer to FIG. 2). The cover 3 is opened by the energizing forces of the energizing portions 29A (refer to FIG. 2). The user mounts the roll in the form holder 9 (refer to FIG. 2).

The user pushes the support portion 54 of the peeling mechanism 5 toward the frame 52. The peeling mechanism 5 enters the stored state. Each one of the second extending portions 552 of the pair of the second restricting portions 55 (refer to FIG. 5) comes into contact with the rear side of the third member 543 of the support portion 54 (refer to FIG. 5) and restricts the movement of the support portion 54 toward the rear. Next, the user pivots the rear edge of the peeling mechanism 5 downward and moves the peeling mechanism 5 toward the front in a state in which the first member 521 of the frame 52 is horizontal. The front edge of the peeling mechanism 5 comes into contact with the rear edge of the inclined portion 2A of the body 2. The pair of the anchoring portions 73 (refer to FIG. 10) come into contact with the rear side of the corresponding ones of the pair of the anchoring portions 57 of the frame 52 (refer to FIG. 10) and restrict the movement of the peeling mechanism 5 toward the rear. The peeling mechanism 5 is held in the fourth state.

Figure 2:
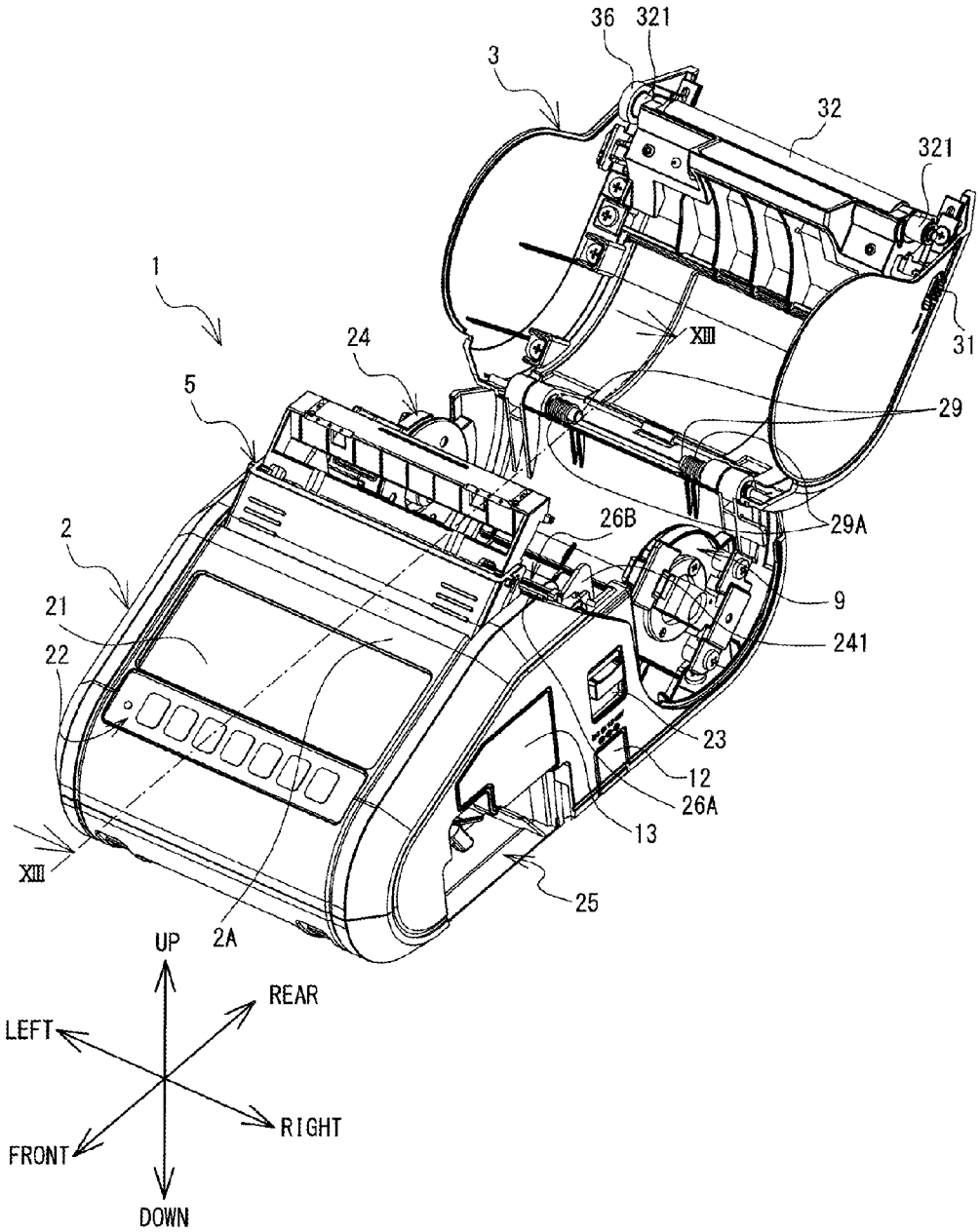
FIG. 2 is an oblique view of the printer 1 (in a state in which the cover 3 is open)

The user closes the cover 3 in a state in which the release paper in the leading edge portion of the tape that extends off of the roll is disposed to the rear of the cutting portion 26A and the printing portion 26B (refer to FIG. 2). As shown in FIG. 14, in the process by which the cover 3 is closed, the projecting portions 53 of the support portion 54 of the peeling mechanism 5 (refer to FIG. 4) do not come into contact with the first guide portions 331 of the cover 3. The peeling mechanism 5 is therefore not moved by the moving portions 331A of the first guide portions 331. As shown in FIG. 15, when the cover 3 is in the closed state, the engaging portions 241 are engaged with the engaged portions 321. The cover 3 is held in the closed state.

Hereinafter, the distance between the shaft portions 523 and the first roller 32 when the cover 3 is closed will be called the third distance. More specifically, in the peel-off mode, in a case where the direction that is orthogonal to both the axis of the shaft portions 523 and the axis of the first roller 32 is defined as the orthogonal direction, the third distance is the distance in the orthogonal direction between a virtual line that extends along the axis of the shaft portions 523 and a virtual line that extends along the axis of the first roller 32. The third distance is greater than the distance between the shaft portions 523 and the second roller 51 (the second distance) in the stored state and is approximately equal to the distance between the shaft portions 523 and the second roller 51 (the first distance) in the protruding state. Note that, more specifically, the third distance is slightly less than the first distance. Accordingly, in the fourth state, the first roller 32 and the second roller 51 (refer to FIG. 5) are separated.

The user presses the switch 22. The printing by the printing portion 26B is started. The first roller 32 rotates in accordance with the rotating of the gears 76, 36 (refer to FIGS. 8 and 9) by the drive portion. The first roller 32 discharges from the discharge outlet 26C the tape that contains the printed heat-sensitive label. Note that the second roller 51 does not come into contact with the discharged tape, so the tape is discharged upward in an extended state. The printed heat-sensitive label is therefore discharged in the state in which it is affixed to the release paper.

Procedure for Operating the Printer 1 in the Peel-Off Mode

The procedure for operating the printer 1 in the peel-off mode will be explained with reference to FIGS. 16 and 17. The procedure up through the mounting of the roll in the form holder 9 is the same as in the normal mode, so an explanation will be omitted. The user moves the peeling mechanism 5 in the fourth state toward the rear. Each one of the pair of the anchoring portions 73 (refer to FIG. 12) deforms elastically and moves toward the front of the corresponding one of the pair of the anchoring portions 57 of the frame 52 (refer to FIG. 12). Each one of the pair of the anchoring portions 73 comes into contact with the front of the corresponding one of the pair of the anchoring portions 57 and restricts the movement of the peeling mechanism 5 toward the front. A space is formed between the front edge of the peeling mechanism 5 and the rear edge of the inclined portion 2A of the body 2 (refer to FIG. 1). The front edge of the peeling mechanism 5 enters a state in which it can rotate, with the shaft portions 523 serving as pivot points. The peeling mechanism 5 is pivoted by the energizing force of each one of the pair of the second energizing portions 72, and the rear edge of the peeling mechanism 5 moves upward (refer to FIG. 13).

The user applies a force to the support portion 54 of the peeling mechanism 5 in the direction that pulls the support portion 54 out from the frame 52. Each one of the second extending portions 552 of the pair of the second restricting portions 55 (refer to FIG. 5) deforms elastically downward. Each one of the second extending portions 552 of the pair of the second restricting portions 55 (refer to FIG. 5) moves from the rear side of the third member 543 of the support portion 54 toward the front side. In addition, the projecting portion 542A of each one of the second members 542 of the support portion 54 (refer to FIG. 7) moves to the outside, in the left-right direction, of the portion where the first extending portion 561 and the second extending portion 562 are connected in the corresponding one of the pair of the third restricting portions 56 (refer to FIG. 7). The peeling mechanism 5 is switched from the stored state to the intermediate state.

The user applies an additional force to the support portion 54 of the peeling mechanism 5 in the direction that pulls the support portion 54 out from the frame 52. Each one of the pair of the third restricting portions 56 deforms elastically toward the inside in the left-right direction. The projecting portions 542A (refer to FIG. 7) move to the rear of the portions where the second extending portions 562 and the third extending portions 563 are connected in the pair of the third restricting portions 56. The peeling mechanism 5 is switched from the intermediate state to the protruding state. Each one of the third extending portions 563 comes into contact with the corresponding one of the projecting portions 542A and restricts the movement of the support portion 54 toward the front. The peeling mechanism 5 is held in the first state.

The user takes the release paper in the leading edge portion of the tape that extends off of the roll and positions it to the rear of the cutting portion 26A and the printing portion 26B (refer to FIG. 2) and below the second roller 51, which is supported by the support portion 54 of the peeling mechanism 5. With the release paper in that state, the user performs the operation that closes the cover 3. As shown in FIG. 16, in the process by which the cover 3 is closed, the projecting portions 53 of the support portion 54 of the peeling mechanism 5 (refer to FIG. 4) come into contact with the bottom sides of the moving portions 331A (refer to FIG. 3) of the first guide portions 331 of the cover 3 (refer to FIG. 3). As the cover 3 is gradually closed, the projecting portions 53 move toward the rear along the bottom sides of the moving portions 331A. The movement of the projecting portions 53 causes the rear edge of the peeling mechanism 5 to pivot downward against the energizing forces of the pair of the second energizing portions 72, with the shaft portions 523 on the front edge serving as pivot points. The second roller 51 (refer to FIG. 7), which is supported by the first member 541 of the support portion 54, moves downward and gradually approaches the first roller 32, which is supported by the cover 3, from above (refer to FIG. 17).

When the cover 3 is in the closed state, the engaging portions 241 are engaged with the engaged portions 321, and the cover 3 is held in the closed state. The peeling mechanism 5 pivots until the first member 521 of the frame 52 is in a horizontal state. The support portion 54 of the peeling mechanism 5 enters a state in which it protrudes horizontally toward the rear from the frame 52. The second roller 51, which is supported by the support portion 54, is disposed obliquely above and to the rear of the first roller 32, which is supported by the cover 3. The first roller 32 and the second roller 51 are close to one another in a state in which a small gap is provided between them. Hereinafter, the state of the peeling mechanism 5 after the rear edge of the peeling mechanism 5 that is in the protruding state has been pivoted downward in accordance with the operation of closing the cover 3, that is, the state in which the support portion 54 protrudes horizontally toward the rear from the frame 52, will be called the second state.

The user presses the support portion 54 of the peeling mechanism 5 in the second state downward toward the top side of the second member 3B of the cover 3. The rear edge of the peeling mechanism 5 pivots further downward from the second state. The projecting portions 53 of the support portion 54 of the peeling mechanism 5 (refer to FIG. 4) come into contact with the extending portions 332A (refer to FIG. 3) of the second guide portions 332 of the cover 3 (refer to FIG. 3)

from above. Each one of the projecting portions 53 moves obliquely downward and toward the rear along the edge of the corresponding extending portion 332A. Each one of the projecting portions 53 moves to a position where it comes into contact with the first restricting portion 331B of the corresponding one of the first guide portions 331 (refer to FIG. 3) and presses the first restricting portion 331B toward the rear. The first guide portion 331 moves toward the rear against the energizing force of the first energizing portion 331C. Each one of the projecting portions 53 moves to a position where it is lower than the corresponding first restricting portion 331B. In a case where, after moving, each one of the projecting portions 53 has separated from the corresponding first restricting portion 331B, the corresponding first guide portion 331 is moved toward the front by the energizing force of the corresponding first energizing portion 331C. The bottom end of the corresponding first restricting portion 331B comes into contact with each one of the projecting portions 53 from above, restricting the upward movement of the peeling mechanism 5.

Note that when the cover 3 is closed, the distance between the shaft portions 523 and the first roller 32 (the third distance) is approximately equal to the distance between the shaft portions 523 and the second roller 51 (the first distance) in the protruding state. Note that, more specifically, the third distance is slightly less than the first distance, but because the difference between the two distances is small, in the state in which each one of the projecting portions 53 has moved lower than the corresponding first restricting portion 331B, the second roller 51 comes into contact with the rear side of the first roller 32 obliquely from above. Only the release paper is pinched between the first roller 32 and the second roller 51. Hereinafter, the state of the peeling mechanism 5 after the rear edge of the peeling mechanism 5 that is in the protruding state has been pivoted further downward from the second state in accordance with the operation by which the user presses the support portion 54 of the peeling mechanism 5 downward, that is, the state in which the first roller 32 and the second roller 51 are in contact, will be called the third state.

The user presses the switch 22. The printing by the printing portion 26B is started. The first roller 32 rotates in accordance with the rotating of the gears 76, 36 (refer to FIGS. 8 and 9) by the drive portion, and the tape that contains the printed heat-sensitive label is discharged from the discharge outlet 26C. Note that the release paper is pinched between the second roller 51 and the first roller 32, so the release paper is bent toward the rear and is discharged toward the rear. The bending of the release paper causes the printed heat-sensitive label that is affixed to the release paper to be peeled off of the release paper and discharged upward from the discharge outlet 26C.

The procedure for opening the cover 3 of the printer 1 in the peel-off mode will be explained. The user moves the lever 31 toward the rear. In accordance with the movement of the lever 31 toward the rear, the first guide portions 331 of the cover 3 move toward the rear. The first restricting portions 331B move away from the projecting portions 53 of the peeling mechanism 5. The peeling mechanism 5 becomes able to pivot in the direction in which its rear edge moves upward. Note that in the peeling mechanism 5, the pair of the second energizing portions 72 cause upward energizing forces to act on the rear edge. Therefore, as the lever 31 moves toward the rear, the peeling mechanism 5 pivots in the direction in which its rear edge moves upward. The projecting portions 53 of the peeling mechanism 5 come into contact with the moving portions 331A of the first guide portions 331. The restricting of the movement of the projecting portions 53 by the moving portions 331A stops the pivoting of the peeling mechanism 5. The peeling mechanism 5 is switched from the third state to the second state and is held in the second state.

The user presses the lever 23 downward. In accordance with the pressing of the lever 23, the pair of the engaging portions 241 pivot in a direction that causes the upper ends of the first extending portions 551 to move toward the rear. The pair of the engaged portions 321 are thus released from the pair of the engaging portions 241. Note that the energizing portions 29A (refer to FIG. 2) cause energizing forces to act to move the cover 3 from the closed state to the open state. The cover 3 therefore changes from the closed state to the open state in accordance with the downward pressing of the lever 23.

In accordance with the opening of the cover 3, the moving portions 331A move away from the projecting portions 53. The pair of the second energizing portions 72 cause the peeling mechanism 5 to pivot in the direction in which the rear edge moves upward. The peeling mechanism 5 is switched from the second state to the first state.

As explained above, the peeling mechanism 5 of the printer 1 switches from the first state to the second state in accordance with the operation by which the cover 3 is closed. In the second state, the peeling mechanism 5 is in a state in which the support portion 54 extends horizontally toward the rear. The peeling mechanism 5 can be switched to the third state by the downward pressing of the support portion 54. The user is therefore easily able to switch the peeling mechanism 5 from the second state to the third state at the same time that he performs the operation of closing the cover 3. In a case where printing is performed with the peeling mechanism 5 in the third state, the printer 1 discharges the heat-sensitive label while peeling the heat-sensitive label off of the release paper. The user is therefore easily able to switch the state of the printer 1 to the peel-off mode by performing the operation of closing the cover 3. Furthermore, in a case where the peeling mechanism 5 has been switched to the third state, the peeling mechanism 5 is inhibited from reverting to the second state by the restricting of the movement of the projecting portions 53 by the first restricting portions 331B. The peeling mechanism 5 can therefore be operated in a stable manner with the printer 1 in the peel-off mode.

The first restricting portions 331B of the first guide portions 331 move toward the front in accordance with the energizing forces of the first energizing portions 331C and restrict the movement of the projecting portions 53. The first restricting portions 331B therefore restrict the movement of the projecting portions 53 appropriately. Furthermore, by moving the first restricting portions 331B toward the rear against the energizing forces of the first energizing portions 331C, the user is able to undo the restricting of the movement of the projecting portions 53 by the first restricting portions 331B. The user can therefore easily switch the peeling mechanism 5 from the third state to the second state, so the user is easily able to switch the operating mode of the printer 1.

When the user presses down on the support portion 54, the extending portions 332A of the second guide portions 332 guide the projecting portions 53 obliquely downward and toward the rear. The user can therefore easily switch the state of the printer 1 from the second state to the third state.

The pair of the second energizing portions 72 cause energizing forces to act in the direction that causes the rear edge of the peeling mechanism 5 to move upward. In a case where the user has performed the operation that undoes the restricting of the movement of the projecting portions 53 by the first restricting portions 331B, the peeling mechanism 5 automatically pivots, and the rear edge moves upward. The user can therefore easily switch the peeling mechanism 5 from the third state to the second state. Furthermore, in a case where the user has performed the operation that opens the cover 3, the peeling mechanism 5 automatically pivots, and the rear edge moves further upward. The user can therefore easily switch the peeling mechanism 5 from the second state to the first state. That makes it possible for the user to easily switch the operating mode of the printer 1 to one of the normal mode and the peel-off mode.

In a case where the operating mode of the printer 1 has been switched to the normal mode, by causing the anchoring portions to hold the peeling mechanism 5 in the fourth state, the user is able to operate the printer 1 in the operating mode in which the label is not peeled off of the release paper.

In a case where the peeling mechanism 5 is in the fourth state, the peeling mechanism 5 is in the stored state, and the distance between the shaft portion 523 and the second roller 51 is the second distance. In this case, even if the user performs the operation that closes the cover 3, the peeling mechanism 5 will not move, and the first roller 32 and the second roller 51 will not come into contact. Therefore, by putting the peeling mechanism 5 into the fourth state, the user can dispose the peeling mechanism 5 such that the second roller 51 will not come into contact with the first roller 32. The user is therefore able to operate the printer 1 in the normal mode by putting the peeling mechanism 5 into the fourth state.

The second restricting portions 55 of the peeling mechanism 5 can restrict the support portion 54 from being switched from the stored state to the intermediate state. In addition, the third restricting portions 56 of the peeling mechanism 5 can restrict the support portion 54 from being switched from the protruding state to the intermediate state. The printer 1 can therefore be operated in a stable manner in both the normal mode and the peel-off mode. The second restricting portions 55 and the third restricting portions 56 are able to inhibit the operating mode of the printer 1 from being switched unintentionally.

Note that the present disclosure is not limited to the embodiment that is described above, and various types of modifications can be made. Each one of the moving portions 331A of the pair of the first guide portions 331 that are described above may also be provided with a groove along which the corresponding one of the projecting portions 53 passes. Each one of the moving portions 331A may also switch the peeling mechanism 5 from the first state to the second state by moving each one of the pair of the projecting portions 53 along the corresponding groove when the cover 3 closes. Each one of the first restricting portions 331B may also have a bottom end that is shaped such that the corresponding one of the pair of the projecting portions 53 can be locked to it (for example, a bottom end with a downward-facing recessed portion). Each one of the pair of the first restricting portions 331B may also be switched, by pivoting, between a state in which it restricts the movement of the corresponding one of the pair of the projecting portions 53 and a state in which it does not restrict the movement. The moving portions 331A and the first restricting portions 331B may also be separate members. In that case, the moving portions 331A may also be part of the cover 3. The first guide portions 331 may also be provided such that only the first restricting portions 331B are able to move toward the front and the rear. The first energizing portions 331C may also energize the first restricting portions 331B toward the front. It is also acceptable for only one of the first guide portions 331 to be provided, on one of the left side and the right side of the cover 3.

The pair of the second guide portions 332 may also be provided with grooves along which the projecting portions 53 pass. Each one of the second guide portions 332 may also switch the peeling mechanism 5 from the second state to the third state by moving each one of the pair of the projecting portions 53 along the corresponding groove when the support portion 54 is pressed downward by the user. The second guide portions 332 may also be portions of the first roller 32 on the left and right end of the first roller 32. A restricting portion that restricts the upward movement of the corresponding one of the pair of the projecting portions 53 may also be provided on the lower end of the each one of the pair of the second guide portions 332, as an alternative to the first restricting portion 331B. It is also acceptable for only one of the second guide portions 332 to be provided, on one of the left side and the right side of the cover 3.

The pair of the second energizing portions 72 may also be springs that cause upward energizing forces to act on the rear edge of the peeling mechanism 5. It is also acceptable for only one of the second energizing portions 72 to be provided, below the peeling mechanism 5 and approximately in the center in the left-right direction. It is also acceptable for the pair of the second energizing portions 72 not to be provided. In that case, the user may lift the rear edge of the peeling mechanism 5 upward manually.

The pair of the anchoring portions 73 may also be provided in the peeling mechanism 5, and the pair of the anchoring portions 57 may also be provided on the bases 75 of the body 2. The pairs of the anchoring portions 57, 73 may also be provided in the grooves 71A of the corresponding ones of the pair of the shaft support portions 71. In that case, the pairs of the anchoring portions 57, 73 may also be differences in level that are provided inside the grooves 71A. It is also acceptable for the pairs of the anchoring portions 57, 73 not to be provided.

As an alternative to the pair of the shaft portions 523, the peeling mechanism 5 may have grooves that extend in the front-rear direction on both its left and right ends. In that case, the pair of the shaft support portions 71 may have shaft portions that extend to the inside in the left-right direction. The peeling mechanism 5 may also be configured such that it is able to move toward the front and the rear by causing the shaft portions of the shaft support portions 71 to move along and in relation to the grooves on the left and right ends of the peeling mechanism 5. When the cover 3 is in the closed state, the distance between the shaft portions 523 and the first roller 32 (the third distance) may also be exactly the same as the distance between the pair of the shaft portions 523 and the second roller 51 (the first distance) in the protruding state. Furthermore, when the cover 3 is in the closed state, the distance between the shaft portions 523 and the first roller 32 (the third distance) and the distance between the pair of the shaft portions 523 and the second roller 51 (the first distance) in the protruding state may also be different from the sum of the radii of the first roller 32 and the second roller 51. Even in that case, the first roller 32 and the second roller 51 can be made to come into contact when the peeling mechanism 5 is in the third state.

The shapes of the each one of the pair of the second restricting portions 55 can be modified. It is also acceptable for only one of the second restricting portions 55 to be provided, on one of the left side and the right side. The shapes of the each one of the pair of the third restricting portions 56 can be modified. It is also acceptable for only one of the third restricting portions 56 to be provided, on one of the left side and the right side. The second restricting portions 55 and the third restricting portions 56 may also be formed as a single unit.

What is claimed is:

1. A printer, comprising:

a printing portion that performs printing on a label;

a cover that is provided with a first roller and that is configured to open and close a storing portion that contains a roll around which is wound a release paper to which the label is affixed;

a peeling mechanism that is provided with a second roller and a projecting portion, the peeling mechanism configured to be switched among a first state, a second state, and a third state, the first state being a state in which the second roller is separated from the first roller, the third state being a state in which the second roller is in contact with the first roller, and the second state being a state in which a distance between the first roller and the second roller is less than a distance between the first roller and the second roller in the first state and greater than a distance between the first roller and the second roller in the third state; and a first guide portion that is provided in the cover and that includes a moving portion and a first restricting portion, the moving portion being configured to switch the peeling mechanism from the first state to the second state by moving the projecting portion as the cover changes from an open state to a closed state, and the first restricting portion being configured to restrict the switching of the peeling mechanism from the third state to the second state by restricting movement of the projecting portion.

2. The printer according to claim 1, wherein:

the first restricting portion is configured to move between a position where the first restricting portion restricts the movement of the projecting portion and a position where the first restricting portion does not restrict the movement of the projecting portion, and the printer further comprises:

a first energizing portion that is provided in the cover and that energizes the first restricting portion from the position where the first restricting portion does not restrict the movement of the projecting portion toward the position where the first restricting portion does restrict the movement of the projecting portion.

3. The printer according to claim 1, further comprising:

a second guide portion that guides the projecting portion when the peeling mechanism is switched from the second state to the third state.

4. The printer according to claim 1, further comprising:

a second energizing portion that energizes the peeling mechanism from the third state, through the second state, to the first state.

5. The printer according to claim 1, wherein:

the peeling mechanism is also configured to be switched to a fourth state in which the peeling mechanism is inhibited from moving by the moving portion, and the printer further comprises:

an anchoring portion that is configured to keep the peeling mechanism in the fourth state.

6. The printer according to claim 1, wherein:

the peeling mechanism is provided with a frame that includes a shaft portion, and with a support portion that is provided movably in relation to the frame, that supports the second roller, and that is configured to switch a distance between the shaft portion and the second roller between a first distance and a second distance, the second distance being less than the first distance, the distance between the first roller and the shaft portion when the cover is in the closed state is less than the first distance and greater than the second distance, and the peeling mechanism, in a case where the support portion has switched the distance between the shaft portion and the second roller to the first distance, is switched from the second state to the third state by pivoting around the shaft portion as a pivot point.

7. The printer according to claim 6, wherein:

the peeling mechanism is provided with a second restricting portion and a third restricting portion, the second restricting portion restricting the movement of the support portion in a state in which the distance between the shaft portion and the second roller has been switched to the second distance, and the third restricting portion restricting the movement of the support portion in a state in which the distance between the shaft portion and the second roller has been switched to the first distance.

* * * * *